US008690626B2

(12) United States Patent
Starck, Jr. et al.

(10) Patent No.: US 8,690,626 B2
(45) **Date of Patent: *Apr. 8, 2014**

(54) SURFBOARD LEASH SYSTEM AND METHOD

(75) Inventors: James Phil Starck, Jr., San Diego, CA (US); George Albert Mansfield, III, San Diego, CA (US)

(73) Assignee: Yvuvy, LLC, San Diego, CA (US)

( * ) Notice: Subject to any disclaimer, the term of this patent is extended or adjusted under 35 U.S.C. 154(b) by 68 days.

This patent is subject to a terminal disclaimer.

(21) Appl. No.: 13/165,703

(22) Filed: Jun. 21, 2011

(65) Prior Publication Data

US 2011/0312233 A1 Dec. 22, 2011

Related U.S. Application Data

(63) Continuation-in-part of application No. 12/821,106, filed on Jun. 22, 2010.

(51) Int. Cl.
*B63B 35/00* (2006.01)

(52) U.S. Cl.
USPC ..... 441/75

(58) Field of Classification Search
USPC ..... 441/75; 114/215
See application file for complete search history.

(56) References Cited

U.S. PATENT DOCUMENTS

| | | | | |
|---|---|---|---|---|
| 4,044,415 | A * | 8/1977 | Wood | 441/75 |
| 4,938,725 | A | 7/1990 | Beck | |
| 5,938,492 | A * | 8/1999 | Carlini | 441/75 |
| 6,112,691 | A * | 9/2000 | Bajeli et al. | 114/230.1 |
| 2003/0183176 | A1 | 10/2003 | Morrison | |
| 2007/0039562 | A1 | 2/2007 | Carter | |

* cited by examiner

*Primary Examiner* — Stephen Avila
(74) *Attorney, Agent, or Firm* — Eric B. Alspaugh, APC

(57) ABSTRACT

A surfboard leash system for a surfboard and a method of making it are disclosed. The system may include an insert or receptacle adapted to be disposed within a portion of the surfboard, a reel assembly releasably connected to the insert and having an arm portion terminating in an annular flange, a first elongated line having a first end attached to the reel assembly and a second end capable of being extended from and retracted to the annular flange of the reel assembly, and a second elongated line releasably connectable at a first end to the second end of the first elongated line and adapted to be releasably attached at a second end to a user of the surfboard.

10 Claims, 26 Drawing Sheets

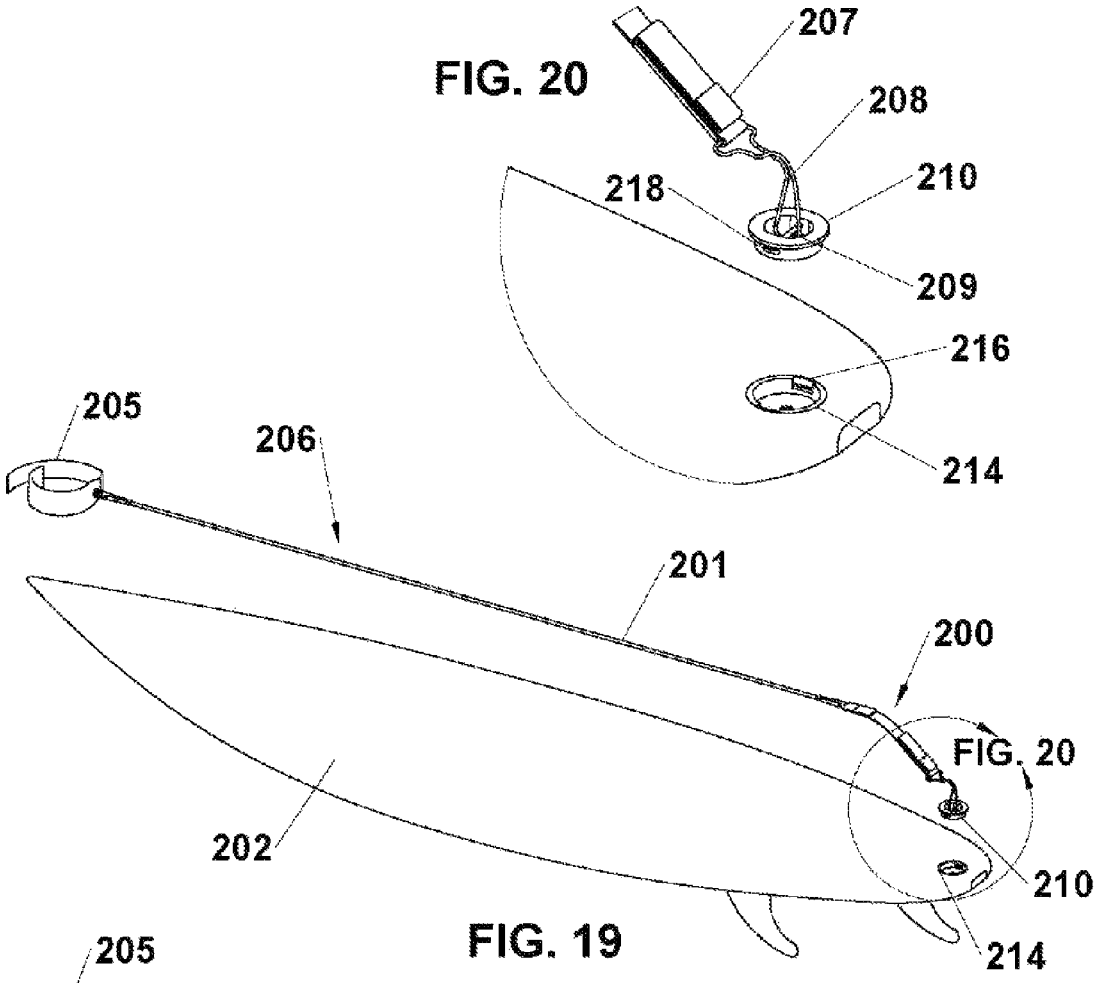
FIG. 20
FIG. 19
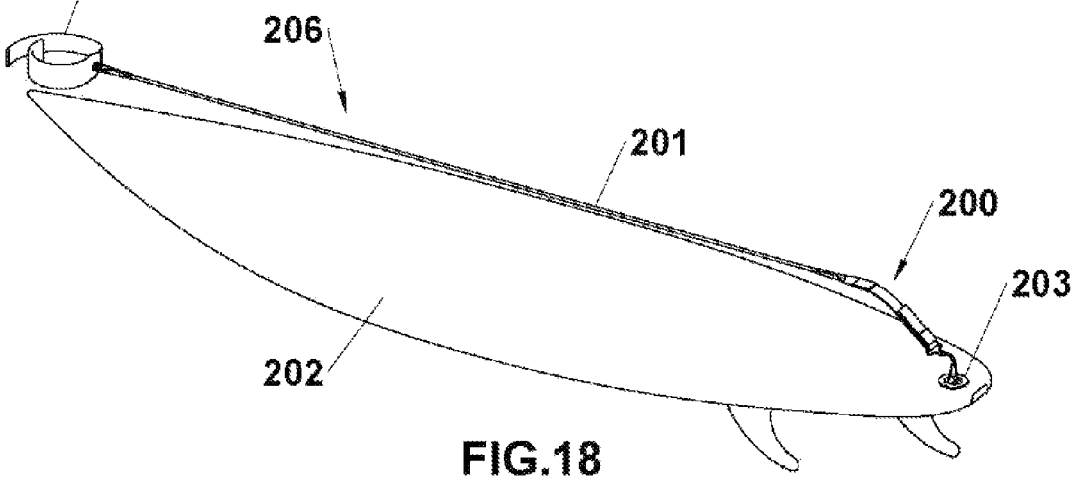
FIG.18

SURFBOARD LEASH SYSTEM AND METHOD

RELATED APPLICATIONS

The present application is a continuation in part patent application of U.S. patent application Ser. No. 12/821,106, filed Jun. 22, 2010, and entitled SURFBOARD LEASH SYSTEM AND METHOD.

FIELD OF THE INVENTION

The present invention relates in general to a surfboard leash and a method of making it. It more particularly relates to a retractable surfboard leash system.

BACKGROUND ART

There is no admission that the background art disclosed in this section legally constitutes prior art.

Leashes for surfboards have been used for many years to prevent the momentary or permanent loss of one's surfboard should the user fall off of his/her surfboard. The leash interconnects the surfboard to the user's ankle. The intermediate portion of the leash forms a loop that often times drags behind the surfboard during use. This can cause an unwanted drag on the surfboard and can collect undesirable debris such as seaweed.

Thus, there have been many different types and kinds of retractable surfboard leashes proposed to help eliminate slack portion of the leash from dragging behind the surfboard. For example, reference may be made to U.S. Pat. Nos. 4,938,725; 5,490,805; 5,902,164; and 5,938,492; Australian patent 704985; and International patent application publications WO 92/00873; WO 99/51489; and WO 2006/045166. Retractable surfboard leashes have been known and have been contemplated for use for many years.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein:

FIG. 18 is a pictorial view of a retractable surfboard leash system constructed according to yet another embodiment of the invention, illustrated being attached to a surfboard;

FIG. 19 is a view similar to FIG. 18, illustrating the fixed leash being detached from its surfboard;

FIG. 20 is an enlarged view of the circled portion of FIG. 19;

DETAILED DESCRIPTION OF CERTAIN EMBODIMENTS OF THE INVENTION

Figure 1:
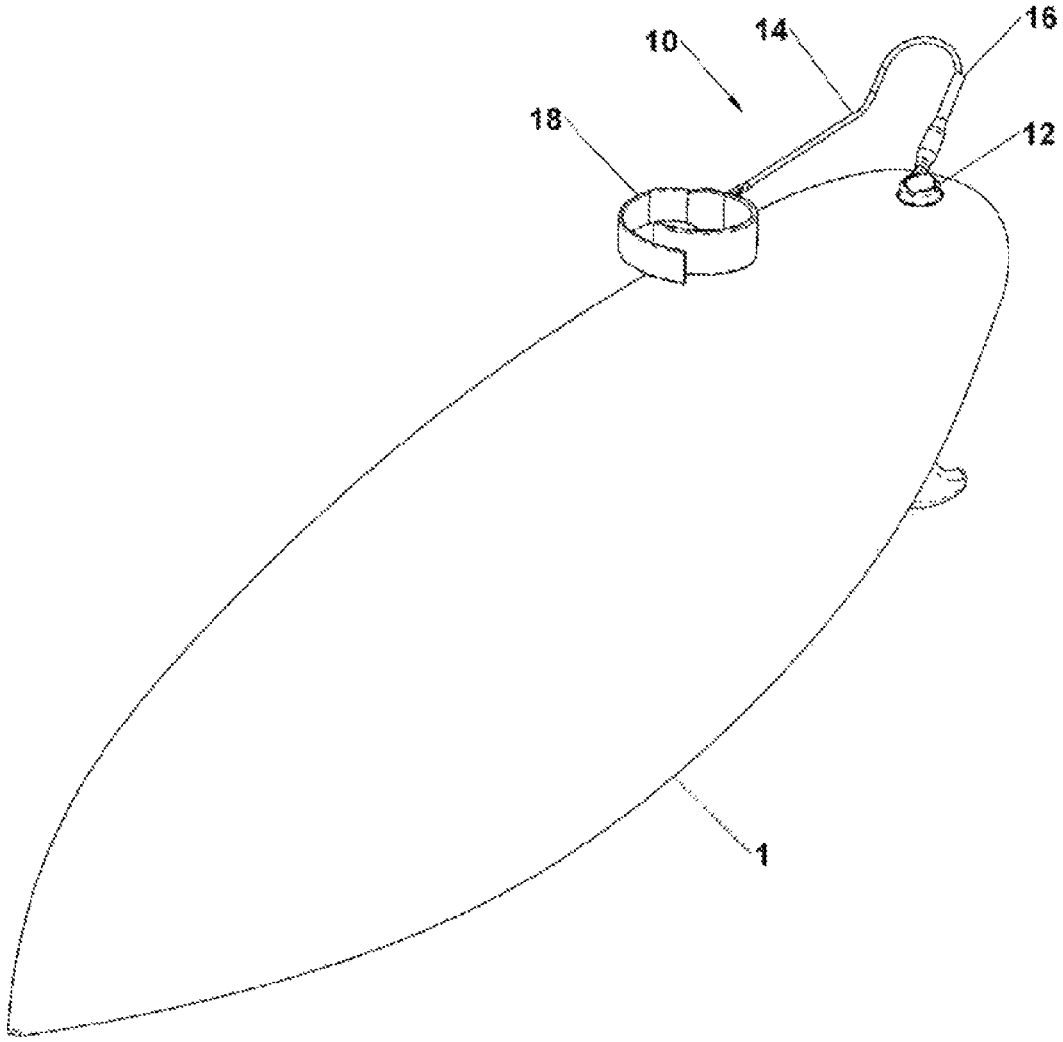
FIG. 1 is a pictorial view of a retractable surfboard leash system constructed according to an embodiment of the invention, illustrated being attached to a surfboard.

It will be readily understood that the components of the embodiments as generally described and illustrated in the drawings herein, could be arranged and designed in a wide variety of different configurations. Thus, the following more detailed description of certain ones of the embodiments of the system, components and method of the present invention, as represented in the drawings, is not intended to limit the scope of the invention, as claimed, but is merely representative of the embodiments of the invention.

There is disclosed a surfboard leash system and a method of making it. At least one embodiment of the present invention may provide a reel assembly mounted on a surfboard and having a first line or cord capable of being extended and retracted, and a second line/cord connected to the first line/cord and adapted to be connected to a user of the surfboard. The system may enable the user to move freely about the surfboard without having an unwanted excess intermediate slack portion of the line dragging behind in the water.

According to one embodiment of the present invention, the retractable surfboard leash system for a surfboard may include an insert or receptacle adapted to be disposed within the surfboard, and a reel assembly releasably connected to the insert and having an arm portion terminating in an annular flange. A set of seals are provided within the reel assembly to help protect its components from corrosion. In one embodiment of the invention, the reel assembly may include a coil spring, which may be composed of a corrosion resistant material such as elgiloy or other such corrosion resistant material. In yet another embodiment, the reel assembly includes a strong thin line composed of suitable material such as Spectra.

According to another important embodiment of the present invention, the retractable surfboard leash system for a surfboard includes a detachable reel assembly releasably connected to an insert fixed to the surfboard. When the reel assembly is removed from the surfboard insert, a leash plug can be releasably attached to the insert so that another leash may be attached alternatively to the leash plug. In this manner, the same inventive reel assembly can be quickly detached from the surfboard and used with other inserts for other surfboards.

According to yet another embodiment of the present invention, the surfboard leash system for a surfboard may include an insert or receptacle adapted to be disposed within the surfboard, conduit means for providing access from the insert to the rear edge of the surfboard, a reel assembly releasably connected to the insert, a first elongated line having a first end attached to the reel assembly and a second end extending through the conduit means and capable of being extended from and retracted to the rear edge of the surfboard, and a second elongated line releasably connectable at a first end to the second end of the first elongated line and adapted to being releasably attached at a second end to a user of the surfboard.

According to still further embodiments of the present invention, the surfboard leash system for a surfboard may include a cup shaped housing having an internal arbor for receiving a spool to rotate thereabout relative to the housing. The spool has a line wrapped thereabout. A rotatable spring housing encloses a spiral spring fixed at one of its ends to the spring housing and fixed at its other end to the arbor to facilitate retracting the line within the housing.

Referring now to FIGS. 1 through 10 of the drawings, there is shown a retractable surfboard leash system constructed in accordance with an embodiment of the present invention and is generally indicated at 10. As shown in FIG. 1, the retractable surfboard leash system 10 for a surfboard 1 may include a reel assembly 12 mounted fixedly on the upper rear portion of the surfboard 1, and a line or cord 14 connected at one end to the reel assembly 12 via connector 16, and connected at its opposite end fixedly to a user attachment device 18 such as an ankle strap for attaching the line 14 to the user.

Figure 3:
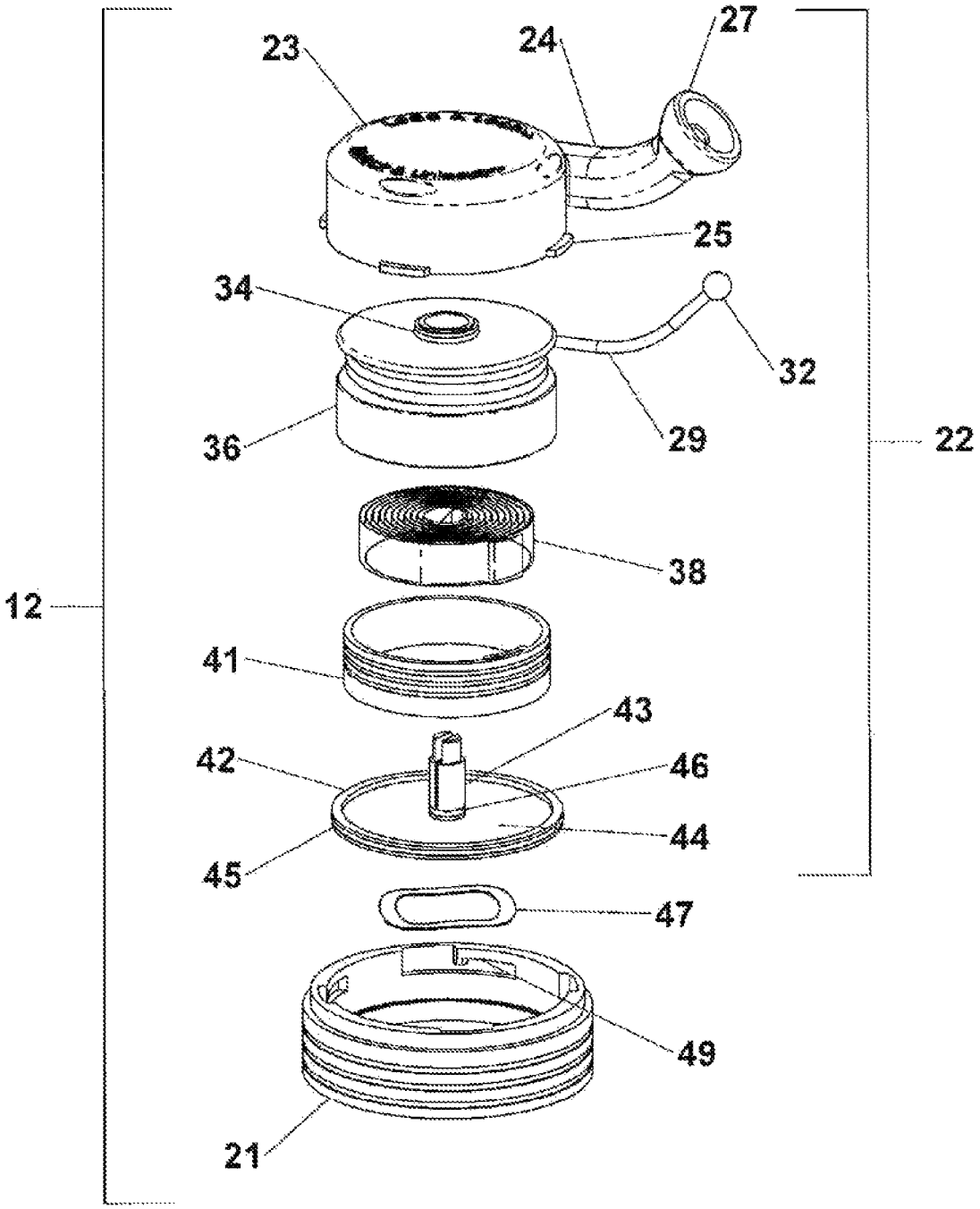
FIG. 3 is a reduced scale exploded pictorial view of the reel assembly of FIG. 2.
Figure 4:
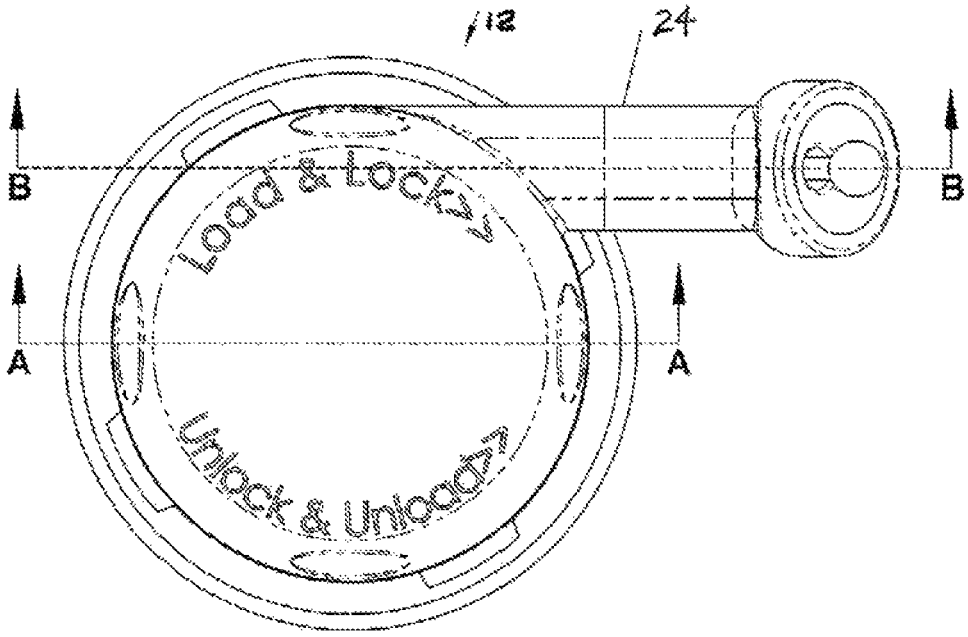
FIG. 4 is a top view of the reel assembly of FIG. 2.
Figure 5A:
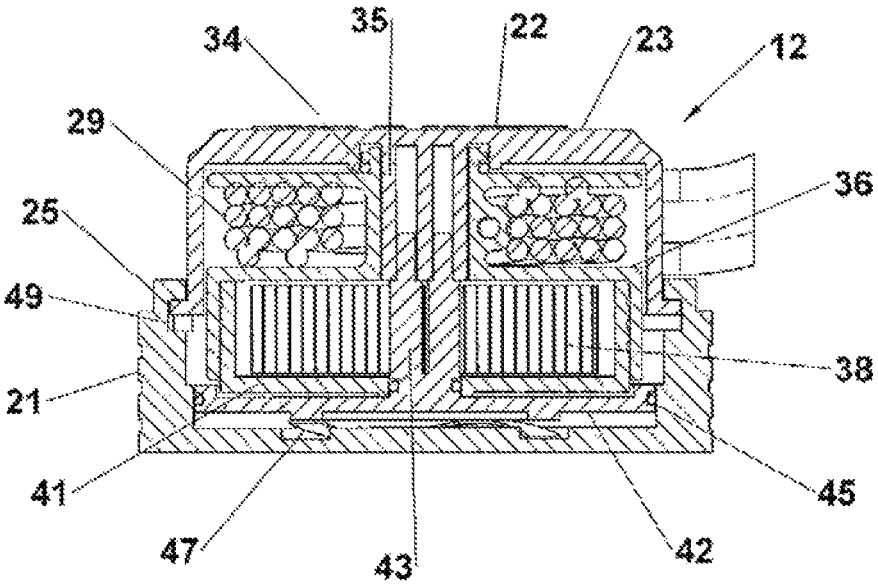
FIG. 5A is a sectional view of the reel assembly of FIG. 4 taken substantially along line A-A thereof.
Figure 5B:
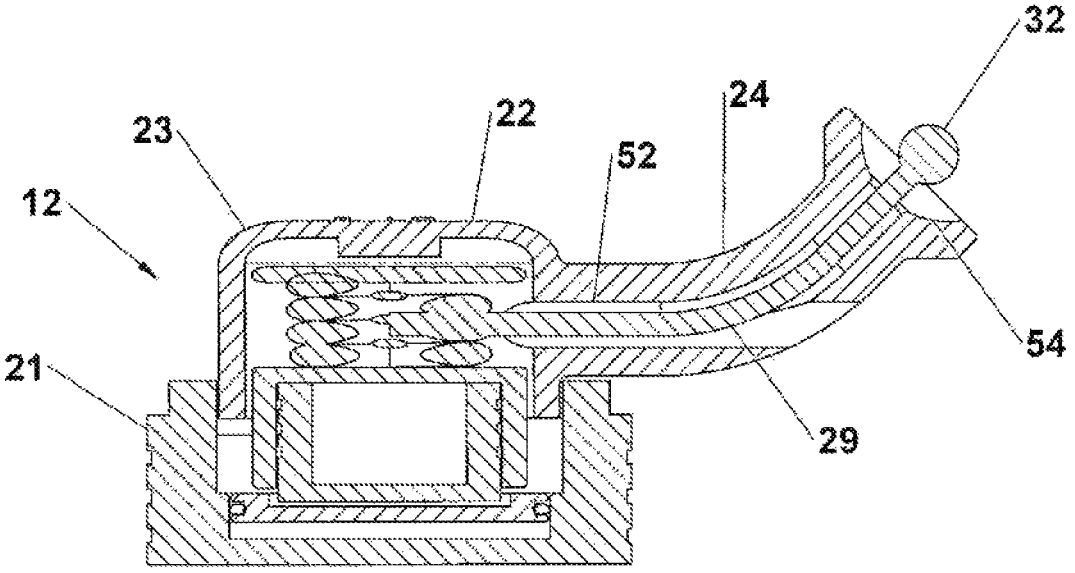
FIG. 5B is a sectional view of the reel assembly of FIG. 4 taken substantially along line B-B thereof.
Figure 6:
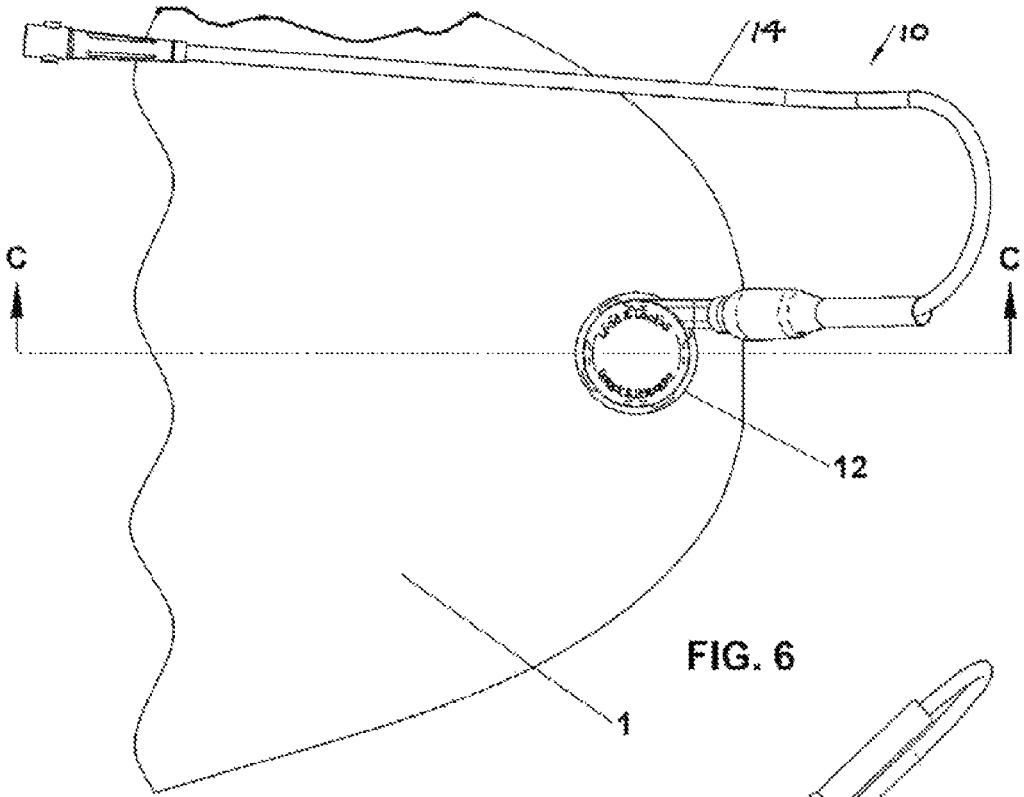
FIG. 6 is a partially-broken away enlarged top view of the retractable surfboard leash system of FIG. 1.
Figure 7:
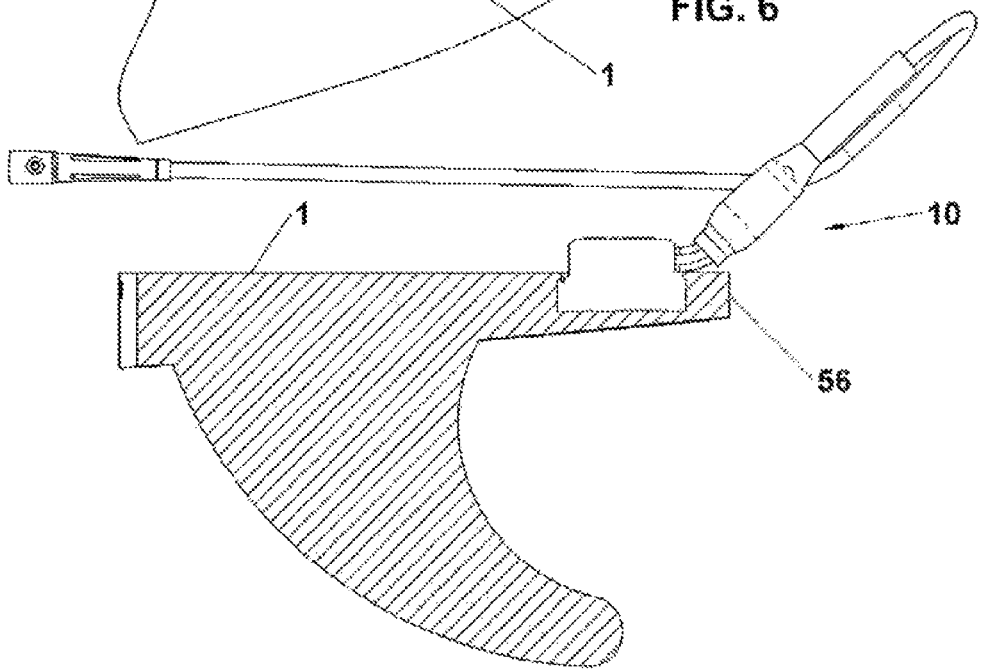
FIG. 7 is a sectional view of the retractable surfboard leash system of FIG. 6 taken substantially along line C-C thereof.

As best seen in FIGS. 3 and 5A, the reel assembly 12 may include a cup-shaped insert or receptacle 21 disposed within the top of and at the middle of the rear of the surfboard 1, and a reel 22 including a reel cover 23 having a generally L-shaped extending arm portion 24 terminating in an annular flange 27. The insert 21 may be manufactured/formed into the surfboard or may be mounted in an existing or created hole in the surfboard using epoxy or other suitable techniques. The cover 23 may include a plurality of outwardly extending locking tabs, such as locking tab 25, for mating with locking notches, such as locking notch 49, in the insert 21.

The reel assembly 12 as best seen in FIG. 3, may include a spool 36 having a retractable line or cord 29 attached thereto. An inner first end (not shown) of the line or cord 29 may be attached to the spool 36 and a portion of the line 29 may be wrapped around the spool 36. The line 29 may be composed of thin strong material such as a Spectra or other suitable material. The line 29 may extend through a passageway 52 in the L-shaped neck portion 24 and out the annular flange 27. The L-shaped neck portion 24 extends upward to elevate the line 29 above the surfboard 1 when extended to avoid damage to the surfboard. The second end of the line 29 may be terminated with a spherical stud 32 for connecting to the line 14 via the connector 16. A dynamic seal, such as an integral or separate O-ring seal 34 may be located on a top portion of the spool 36 to allow free rotation and provide an environmental barrier between the spool 36 and the cover 23.

A flat spiral spring 38 may be disposed in a bottom portion of the spool and have an outer end connected to the spool 36 to provide the capability to retract an extended portion of line 29. The spring 38 may be enclosed within the bottom portion of the spool 36 and a spring cover 41. The spring may be composed of suitable corrosion resistant material, such as elgiloy or other.

A flat bottom plate 42 may include an upwardly extending shaft 43 that extends through the spring cover 41 and engages the inner end of the flat spring 38 to allow the flat spring 38 to be able to store energy to retract the line 29, when the line/cord 29 is extended out of the reel 22. A shaft 35 extending downward from the inside of the cover 23 through the spool 36 may matingly engage and be fastened to a top portion of the shaft 43 of the flat bottom plate 42. The flat bottom plate 42 may also include a smooth flat surface 44 on which at least a portion of the bottom surface of the spring cover 41 rests so that the spool 36 may freely rotate within the reel 22. A dynamic seal such as an integral or separate O-ring seal 46 may be included at the bottom of the shaft 43 to engage an opening in the spring cover 41 to allow free rotation and provide an environmental seal between the spring cover 41 and the shaft 43. A washer 45 may be included in the outer edge of the flat bottom plate 42 to provide an environmental barrier between the reel 22 and the insert 21.

A flat spring 47 may be included in the bottom of the insert 21 to provide an upward force to the bottom of the reel 22 to keep the tabs of the cover 23 locked within the notches of the insert 21.

Figure 8:
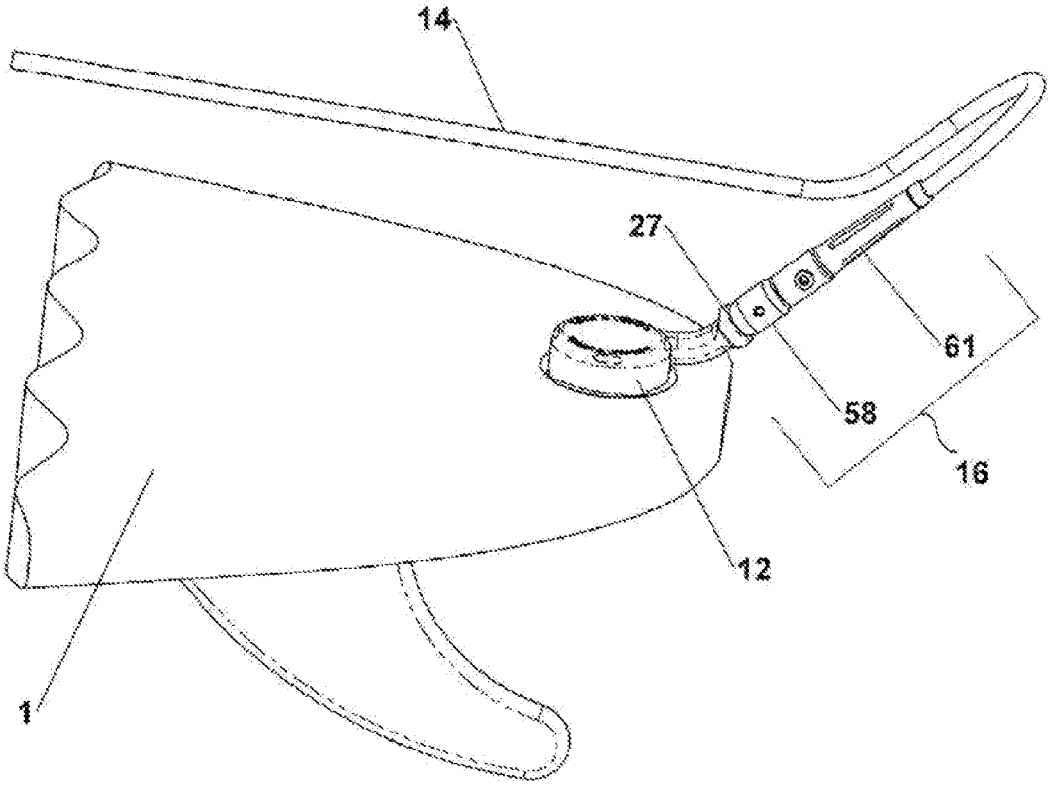
FIG. 8 is a partially broken away pictorial view of the retractable surfboard leash system of FIG. 1.
Figure 9:
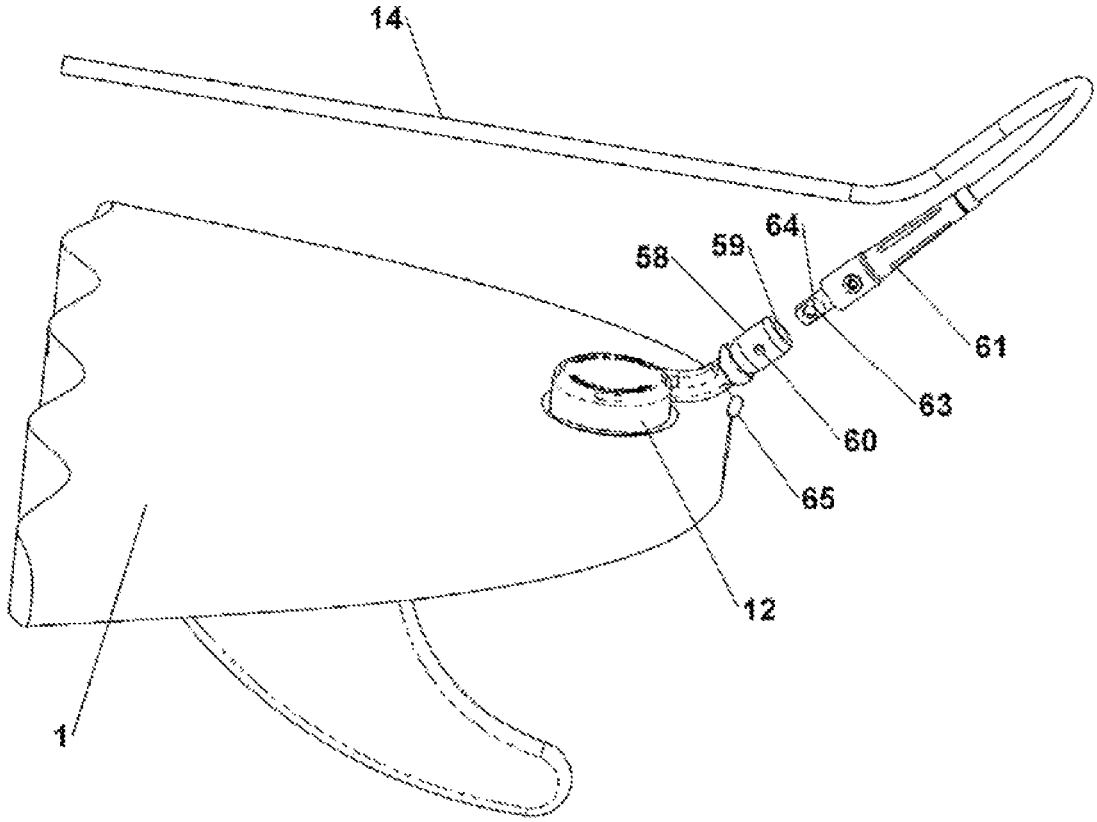
FIG. 9 is a partially broken away pictorial view of the retractable surfboard leash system similar to FIG. 8 with the leash being illustrated disconnected from the reel.

The annular flange 27 may include a recessed portion 54 for receiving a portion of the end of the connector 16. As best seen in FIGS. 8 and 9, the connector 16 may include a first connector section 58 attached to the line 29 using the spherical stud 32 (FIG. 3) and a second connector section 61 attached to a first end of the line 14. The first connector section 58 may include an opening 59 for receiving a narrowed engaging end 63 of the second connector section 61. The connector sections 58 and 61 may be attached together by securing a locking pin 65 through a side opening 60 in the first connector section 58 and engaging an opening 64 in the engaging end 63 of the second connector section 61. The second connector 61 may include a swivel to help prevent entanglement of one or both of the lines/cords.

The line 14 may be similar to that used for conventional surfboard leashes and constructed of the typical material used for surfboard leashes, such as nylon or the like, that may tolerate the wet conditions of use. The length of the line 14 may be between about zero and about four feet depending on the size of the surfboard. The line 29 may have a diameter significantly smaller than the diameter of line 14 and may also be constructed of a water tolerant material, such as nylon or the like. The length of the line 29 may be between about three feet and about nine feet. The user attachment device 18 may be similar to those used on conventional surfboard leashes and may be nine feet composed of conventional materials, such as Velcro®, magnets or other suitable materials.

In using the retractable surfboard leash system 10, a user may attach the user attachment device 18 to himself or herself, typically on one of his/her ankles. The length of the line 14 may be sufficient to allow the user to adequately move about the surfboard, but not so long that the user may become entangled in the line 14. The angularly upwardly inclined L-shaped extending neck portion 24 of the reel assembly 12 may elevate the line 14 sufficiently above the surfboard and direct it to the rear thereof, to help eliminate or reduce the possibility of the user stepping or tripping on the line 14 and to help prevent or at least reduce the possibility of the line 14 cutting into or otherwise damaging the surfboard. When the user desires to move further on the surfboard than is allowed by the length of the line 14, the line 29 may be extended or pulled out of the reel assembly 12 to provide the user the appropriate mobility with little or no restricting of his/her movement.

When the user moves back into the range allowed by the length of line 14, the extended portion of the thinner line 29 may be retracted back into the reel assembly 12. Should the user fall off the surfboard, a portion of the line 29 may be extended out of the reel assembly 12 due to the force of the fall to help prevent injury to the user and to help prevent the user from losing the surfboard in the water. When the user retrieves the surfboard, the line 29 retracts back into the reel assembly 12.

During use, the length of the line 14 may be sufficient to insure a buffer zone between the user and the surfboard. When the line 29 is retracted into the reel assembly 12, the surfboard is not pulled back into the user in such a manner that would be dangerous to the user or disruptive to the user for many applications or typical use of the surfboard.

Figure 10:
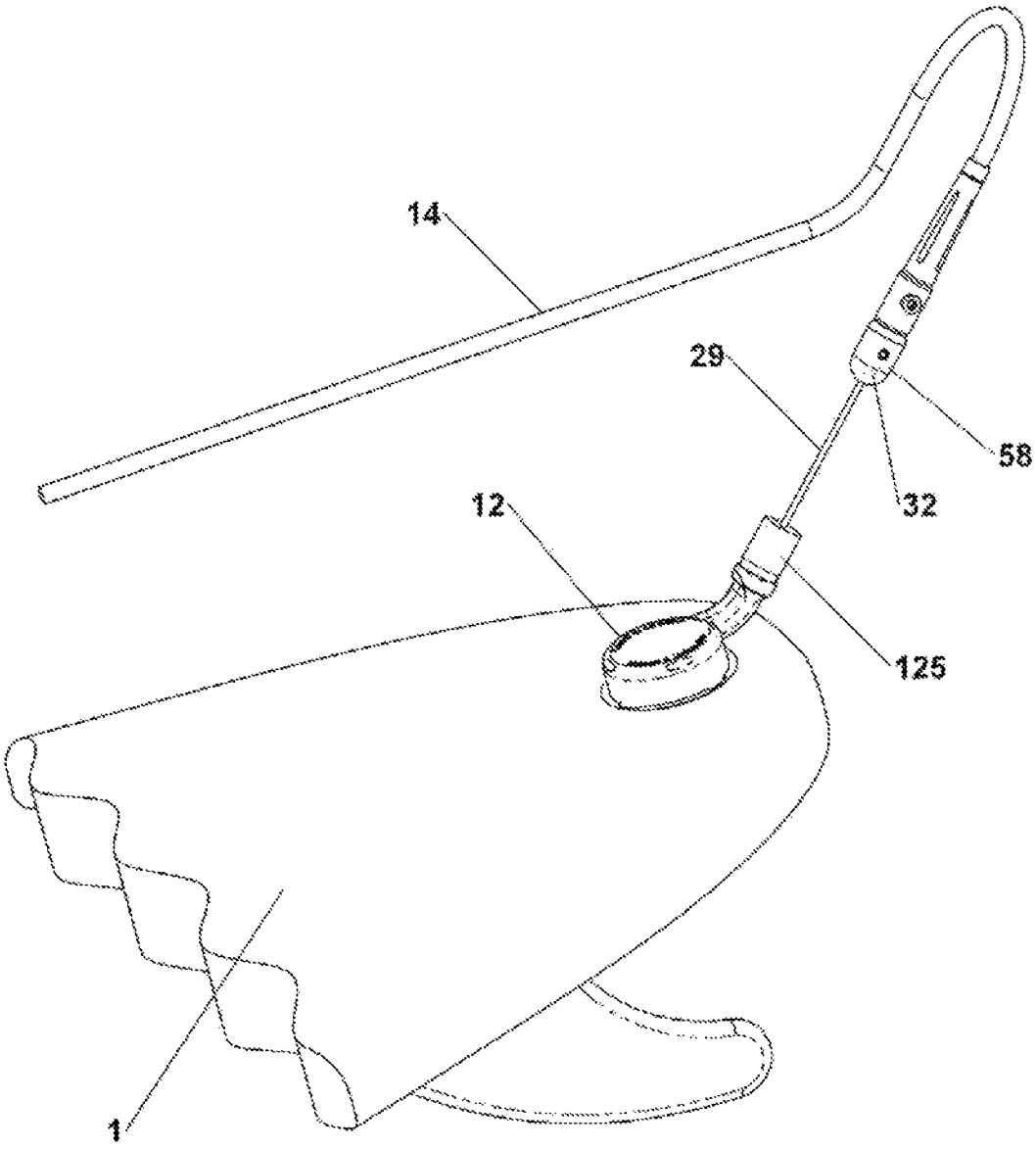
FIG. 10 is a partially broken away sectional pictorial view of the retractable surfboard leash system similar to FIG. 8, being illustrated with a portion of the leash cord being played out from the reel.

As shown in FIG. 10, a sliding block 125 may be fixed adjustably to the line 29 for setting the retraction length of the leash. The sliding block is generally cylindrical in shape and may be composed of a suitable rigid material such as urethane. The block 125 is fixed adjustably to the line 29 by suitable means (not shown), and serves as a stop to limit the length of the line 29 able to be retracted into the reel assembly.

Figure 11:
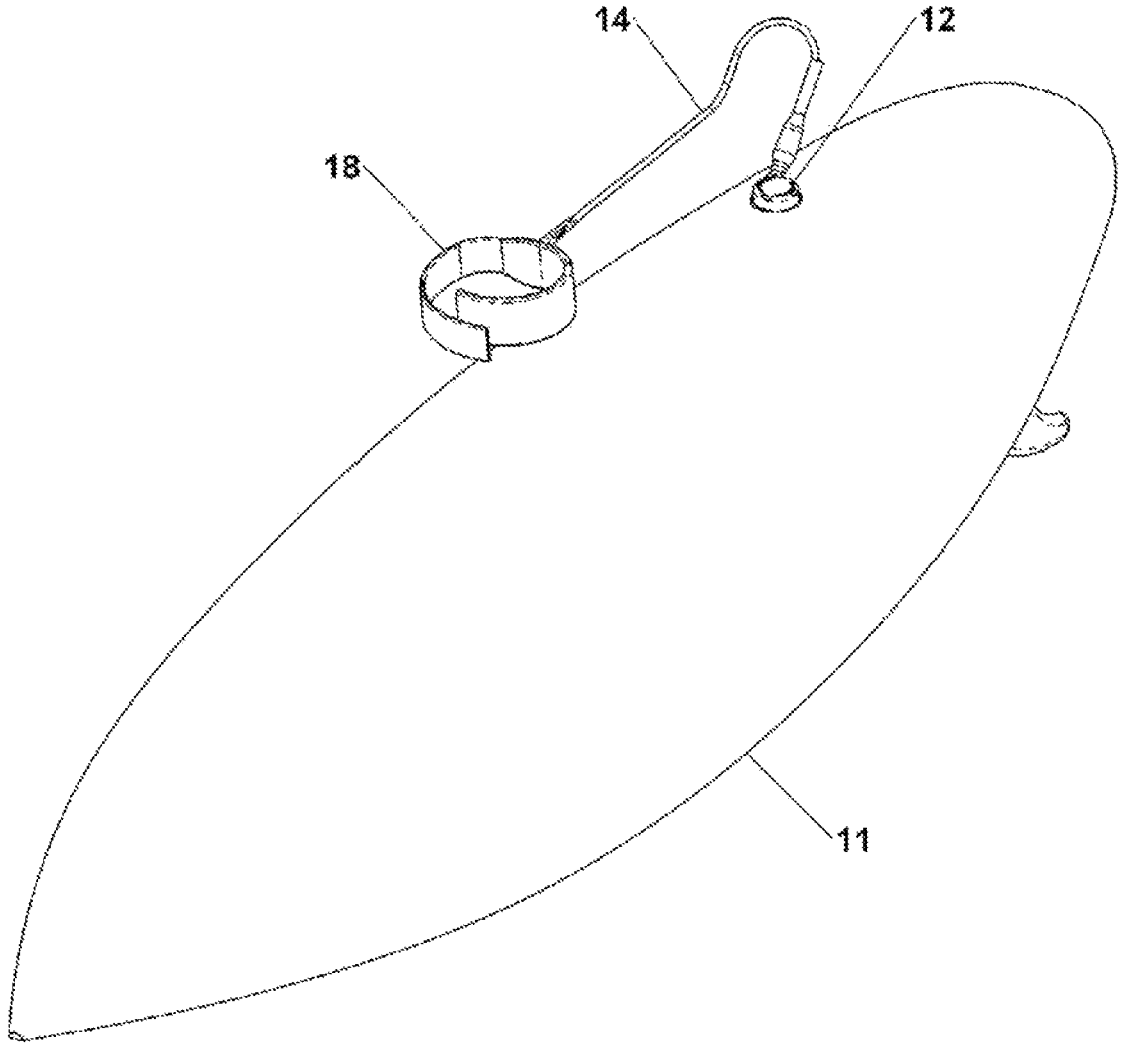
FIG. 11 is a pictorial view of the retractable surfboard leash system of FIG. 1, illustrating it being attached to the surfboard at an alternative location.

Referring now to FIG. 11, the retractable surfboard leash system 10 is shown with its reel assembly 12 disposed in an optional alternative location on the surfboard 11, such as near one side of the rear of the surfboard instead of at the middle of the rear of the surfboard. The location of the reel assembly 12 may be determined by the preference of the user or by the manufacturer of the surfboard.

Figure 12:
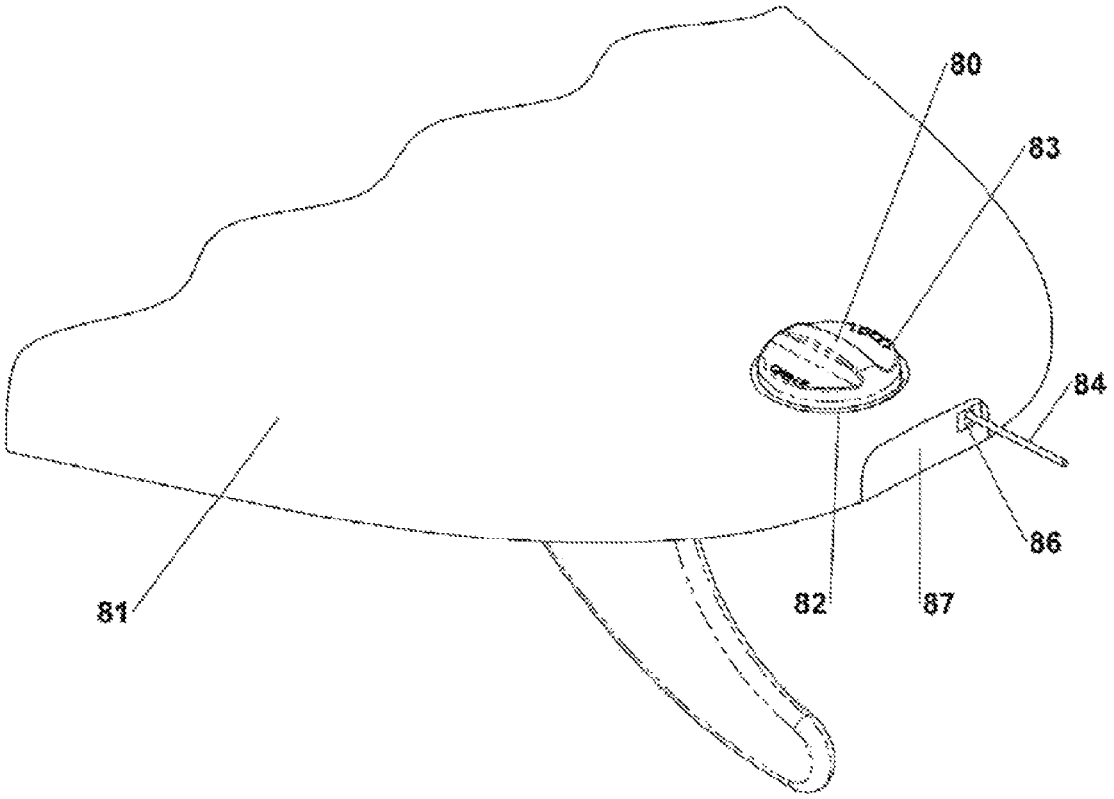
FIG. 12 is a partially broken away pictorial view of another embodiment of the inventive retractable leash system with an alternative reel output location.

Referring now to FIG. 12, an alternate embodiment of mounting a reel assembly 80 on a surfboard 81 is shown. The reel assembly 80 may include an insert 82 formed or mounted into the surfboard 81, a reel 83 having a line or cord 84, and a conduit 86 providing a passageway between the insert 82 and the rear edge 87 of the surfboard 81 to allow the line 84 to exit at the rear of the surfboard. The use of and the other items of a retractable surfboard leash system using the reel assembly 80 may be substantially similar to the use of and those items of the retractable surfboard leash system 10.

Figure 13:
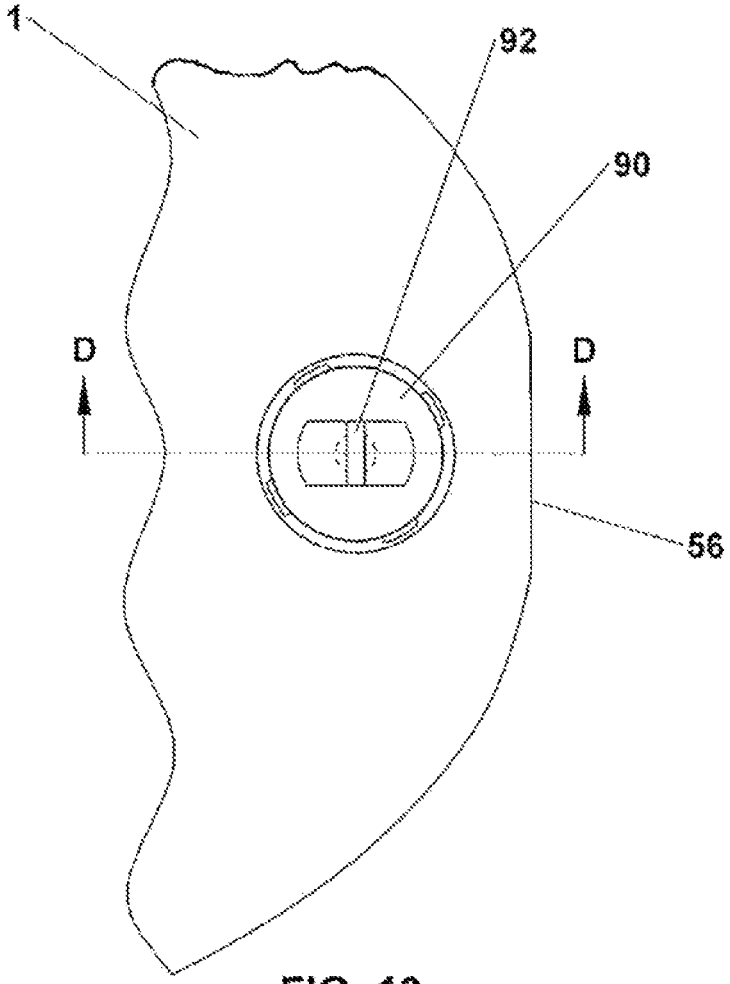
FIG. 13 is a top view of a leash plug for a surfboard according to an embodiment of the invention.
Figure 14:
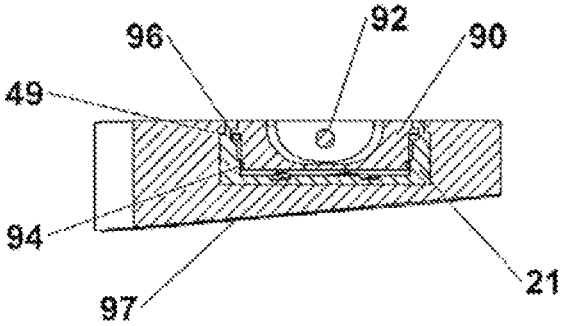
FIG. 14 is a sectional view of the leash plug of FIG. 13 taken substantially along line D-D thereof.

Referring now to FIGS. 13 and 14, an optional leash plug 90 is shown that may be mounted in the insert 21 of the retractable surfboard leash system 10. The leash plug 90 may include a crossbar 92 for attaching a conventional surfboard leash to the surfboard. A plurality of extending tabs, such as tab 96 mate with the locking notches, such as locking notch 49, of the insert 12. A washer or seal 94 provides an environmental barrier to protect the insert 12 and items such as a flat spring 97, which is similar to the spring 47. The insert 21 and leash plug 90 may be provided with a surfboard, such that a user may remove the optional leash plug 90 and replace it with a reel with a retractable cord, such as reel 22 described previously.

Figure 15:
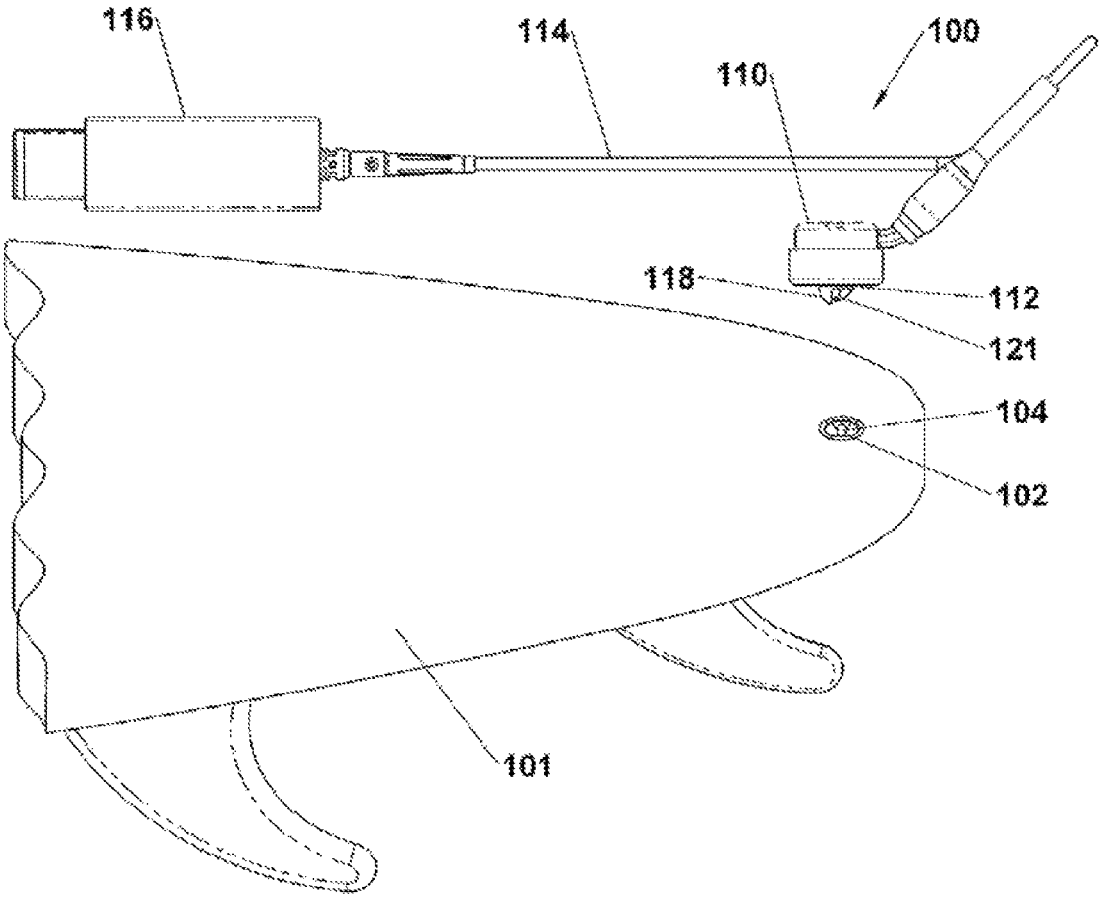
FIG. 15 is a partially broken away pictorial view of another embodiment of the retractable surfboard leash system being capable of being attached to the existing leash plug of a surfboard and being illustrated in the process of being attached to a conventional leash plug mounted to a surfboard.

Referring now to FIG. 15, another embodiment of the retractable surfboard leash system is shown and is generally indicated at 100. The retractable surfboard leash system 100 may be substantially similar to the retractable surfboard leash system 10 except that it may be mounted on a surfboard 101 having a conventional leash plug 102. The retractable surfboard leash system 100 may include a reel assembly 110, a line or cord 114, and a user attachment device 116, all substantially similar to the corresponding items for the retractable surfboard leash system 10, with exception of an alternate mounting device 112 on the reel assembly 110. The mounting device 112 may include a first extending arm 118 and a second extending arm 121 to allow the reel assembly 110 to be clipped to the crossbar 104 of the conventional leash plug 102 of surfboard 101 using the arms 118, 121.

Figure 2:
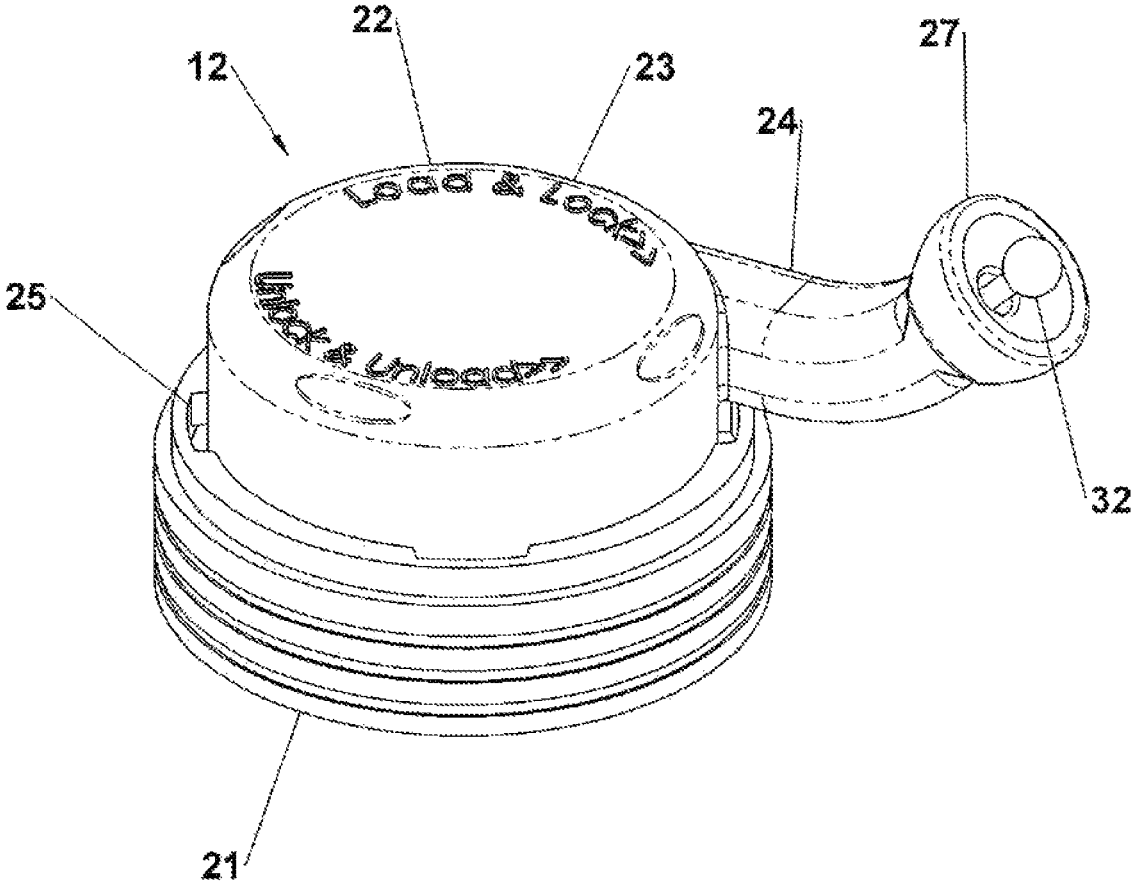
FIG. 2 is an enlarged scale pictorial view of a reel assembly of the retractable surfboard leash system of FIG. 1.
Figure 16:
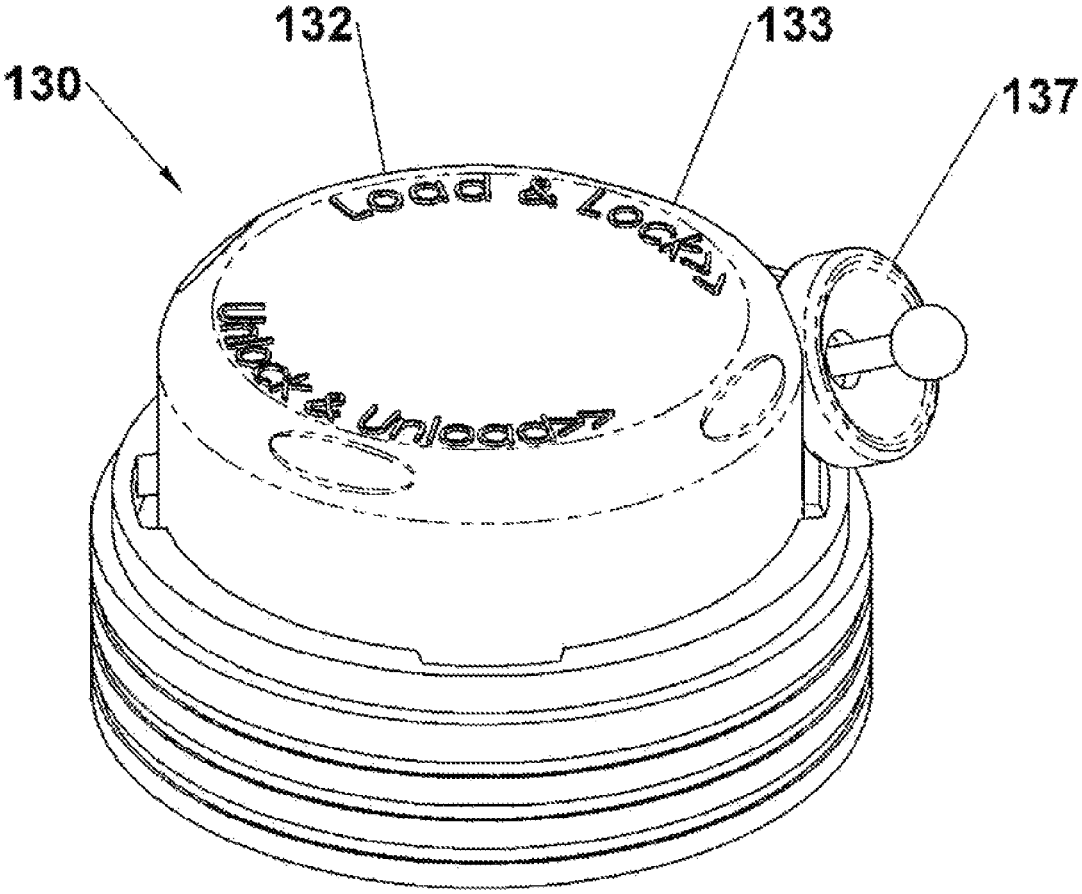
FIG. 16 is a pictorial view of another embodiment of a reel assembly similar to FIG. 3.

Referring now to FIG. 16, there is shown a reel assembly 130, which is constructed according to a further embodiment of the present invention, and which is similar to the reel assembly 12 of FIG. 2 except that it does not have an arm 24. The assembly 130 includes a reel 132 and a reel cover 133. An annular flange 137 is similar to the flange 27 (FIG. 2) for surrounding an outlet, but does not employ an extension arm such as the arm 24 (FIG. 2).

Figure 17:
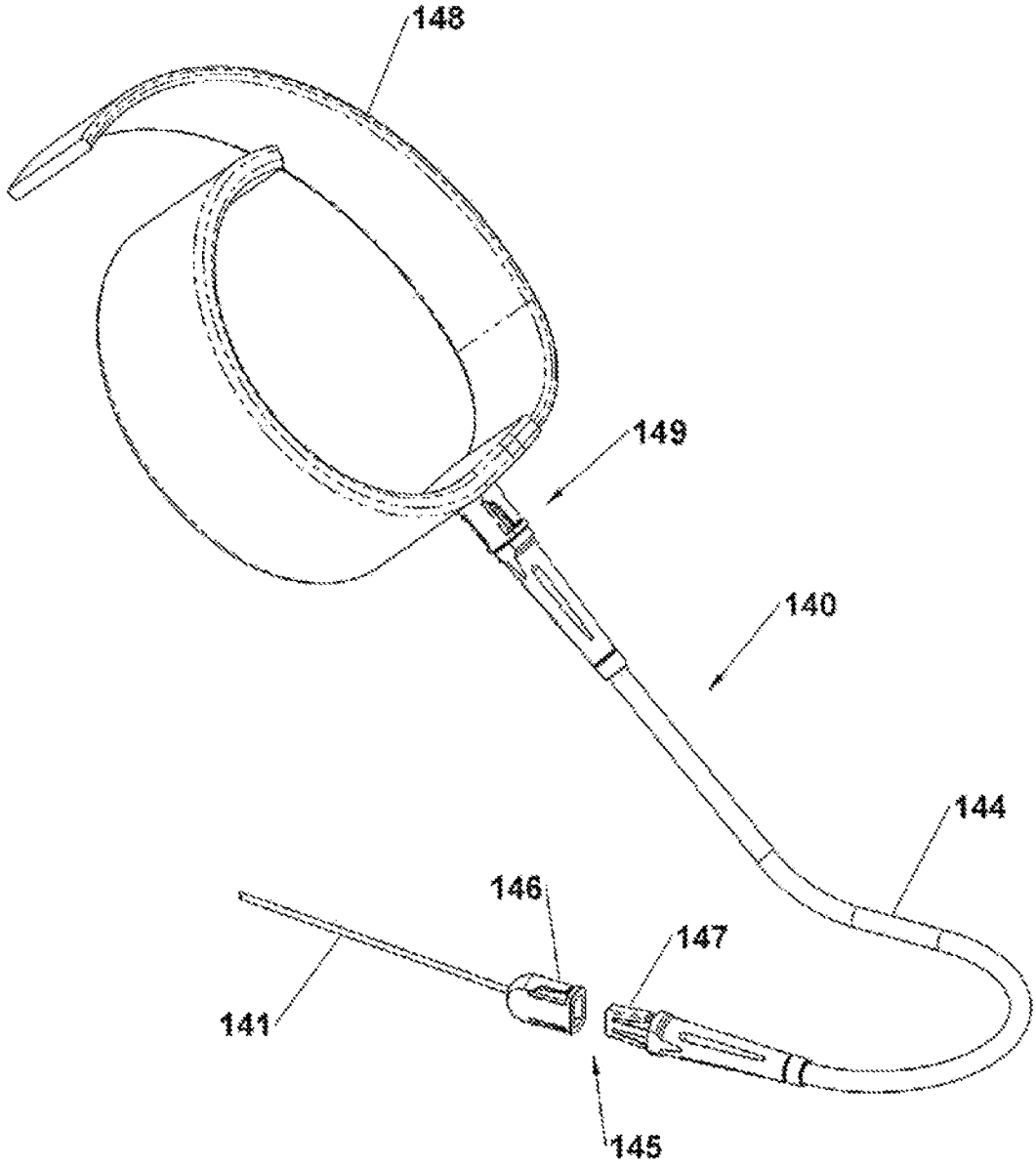
FIG. 17 is a pictorial view of a quick release leash portion of a retractable surfboard leash system of yet another embodiment.

As shown in FIG. 17, there is shown yet another embodiment of a leash portion generally indicated at 140 of a surfboard leash system similar to the system 10 of FIG. 1. The leash portion 140 is a quick release assembly and includes a thin leash line 141 from a reel assembly (not shown) releasably connected at one of its ends to one end of a thick leash line 144 by a quick release connector 145. The connector 145 includes a snap or latch part 147 connected fixedly to the thick leash 144 and adapted to be secured releasably to a socket part connected to the thin leash 141. When the latch part 147 interengages with the socket part 146, the two parts are releasably attached together.

Similarly, another like quick release connector 149 interconnects the other end of the thick leash 144 to an attachment device 148, which is similar to the attachment device 18 of FIG. 1. In use, the quick release connectors 145 and 149 enable the leash portion 140 to have easily and conveniently interchangeable components. For example, the thick leash 144 can be separated from the thin leash 141 and the attachment device 148, and thus replaced with a different thick leash (not shown). In this manner, a worn or broken thick leash can be replaced with a new one. Or, alternatively, a different new thick leash of a different color or design may be used to replace the thick leash 144 in a convenient manner. The same may be true for the thin leash 141 and/or the attachment device 148.

Figure 21:
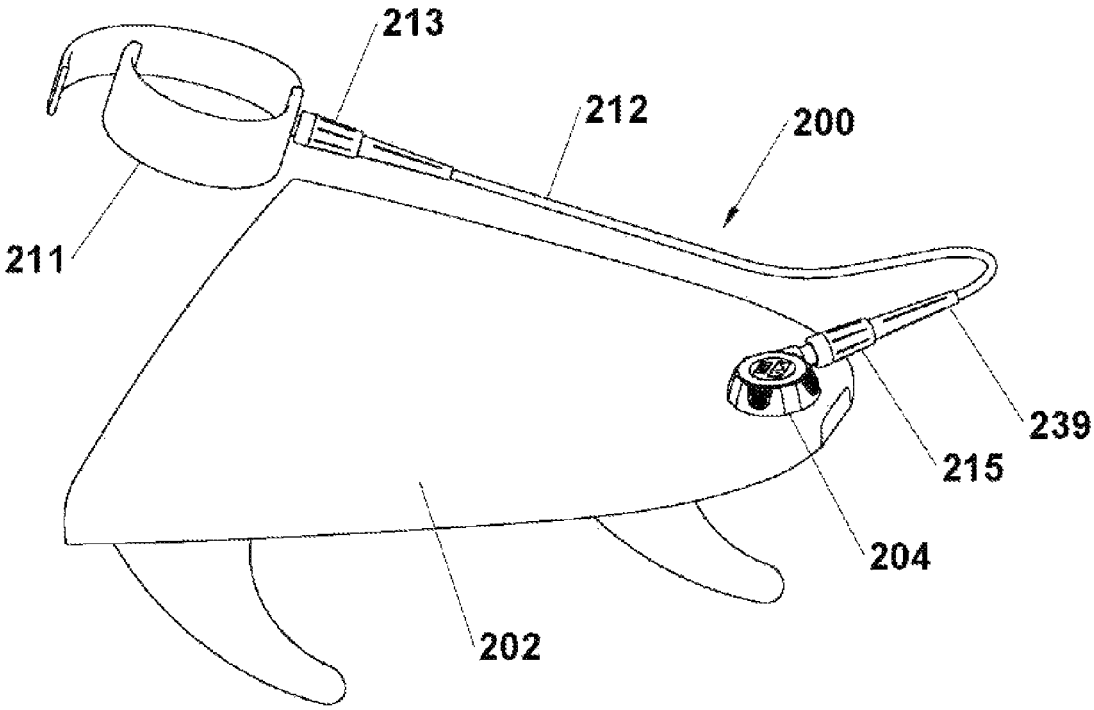
FIG. 21 is an enlarged fragmentary pictorial view of a retractable surfboard leash system in the process of being attached to the surfboard of FIG. 18.

As shown in FIGS. 18-21, a detachable retractable surfboard leash system 200 which is constructed in accordance with yet another embodiment of the invention, and which includes a leash line 201 attached to a surfboard 202 by means of a leash plug assembly 203. As best seen in FIGS. 19 and 20, the leash system 200 can be detached from the surfboard 202 in a similar manner as the leash system 10 of FIG. 1. Once removed, a reel assembly 204 as shown in FIG. 21 may be attached to the surfboard 202 as hereinafter described in greater detail.

The leash system 200 includes a user engageable device such as an ankle strap 205 attached to one end of a leash line or cord 201, which in turn is connected through a rail saver 207 to a loop 208 fixed to a crossbar 209 of a removable plug 210 similar to the removable plug 90 of the system 10. Locking tabs or snaps such as a tab 218 on the plug 210 secures releasably the plug 210 to the insert 214, by engaging with locking notches such as a locking notch 216 on the insert 214. The rail saver 207 is useful in preventing or at least reducing the possibility of the line 201 cutting into or otherwise damaging the surfboard 202.

As best seen in FIG. 21, the leash reel assembly 204 includes a user engageable device such as an ankle strap 211 connected to one end of a leash line or cord 212 by means of a shock absorber 213 to reduce impact on the user of the surfboard 202. The other end of the line or cord 212 is connected to the insert 214 (FIG. 18) of the surfboard 202 through another shock absorber 215, which is similar in construction to the shock absorber 213. In this manner, the user riding on the surfboard 202 is able to better withstand the force of the waves acting on the surfboard 202 during use thereof.

Figure 22:
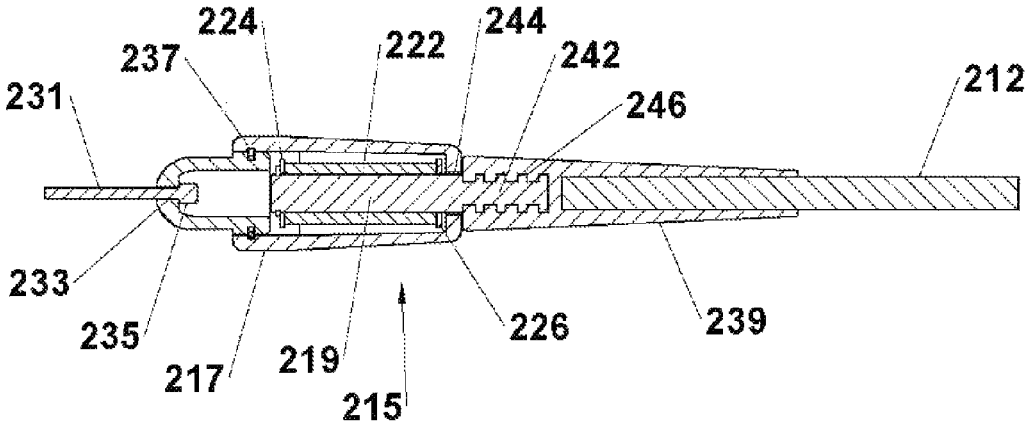
FIG. 22 is an enlarged sectional view of a shock absorber of the retractable surfboard leash system of FIG. 21.
Figure 23:
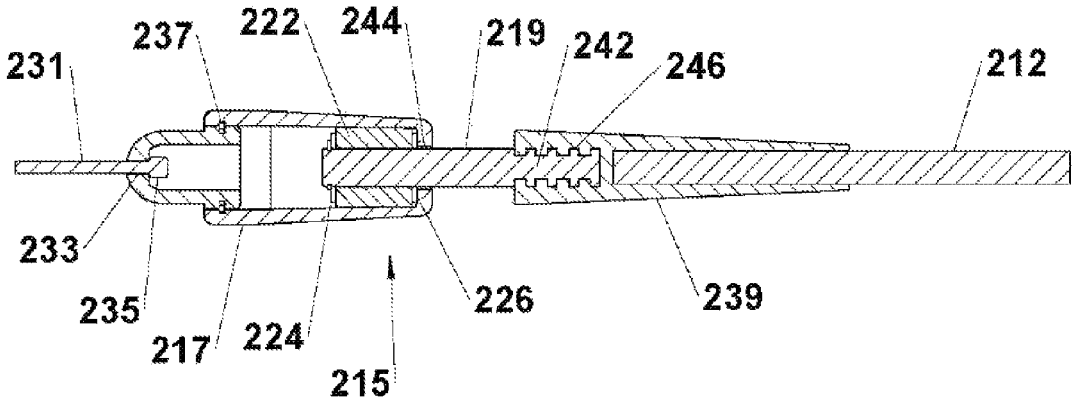
FIG. 23 is a view similar to FIG. 22, but illustrating the shock absorber in the process of being extended in tension.

With reference to FIGS. 22 and 23, the shock absorber 215 will now be described in greater detail, it being understood that the shock absorber 213 is similar to the shock absorber 215 and will not be described in further detail. The shock absorber 215 includes a tubular housing 217 having an axial rod or post 219 disposed partially therein for compressing a shock absorbing tubular deformable sleeve 222 when tensile forces are applied to the leash line 212 as shown in FIG. 23. The shock absorbing sleeve 222 is composed of a compressible pliable resilient material such, for example, as a material marketed under the trade name Sorbothane.

A compression washer 224 is fixed in the inner end of the rod 219 to engage the shock absorbing sleeve 222. A compression washer 226 engages the other end of the shock absorbing sleeve 222 and is fixed to the rod 219. In this manner, as the rod 219 moves extensively within the tubular housing 217, the sleeve 222 is compressed or relieved depending on the direction of movement of the rod 219.

A cup shaped swivel 228 is fixed to a retractable line or cord 231 of the reel assembly 204 by means of an enlarged end 235 of the line 231. The line 231 extends through an opening 233 in the swivel 231, which has a swivel bearing 237 attached to its opposite open end to provide a rotatable attachment to the end of the tubular housing 217. A connector 239 is fixed to a rear end 242 of the rod 219 which extends through an opening 244 in the rear end of the tubular housing 217 by means of a series of annual anchor projections such as the projection 246 on the rear end 242 of the rod 219.

Referring now to FIGS. 24 through 30 of the drawings, the reel assembly 204 will now be considered in greater detail 248.

Figure 24:
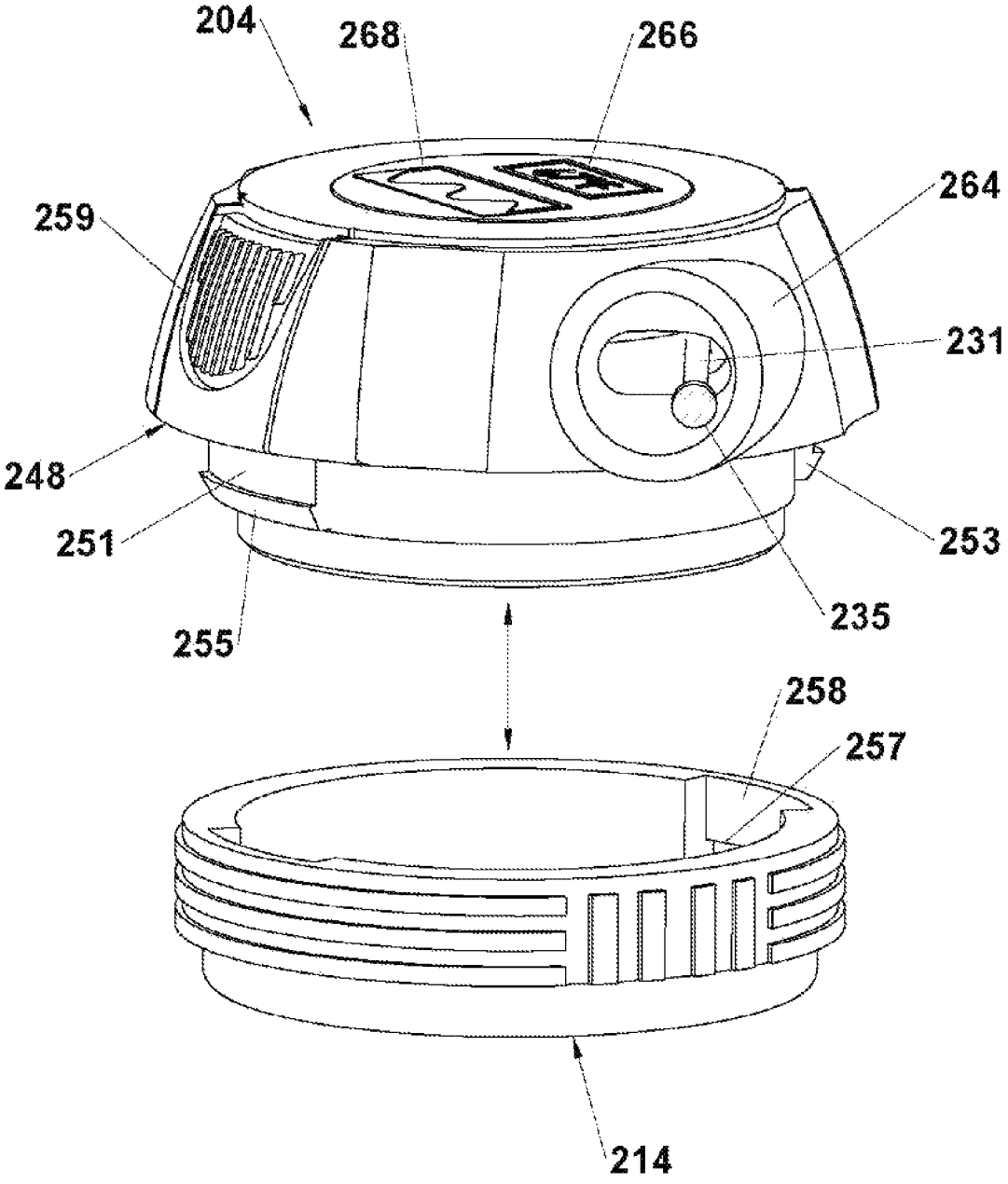
FIG. 24 is an enlarged pictorial view of the retractable surfboard leash system of FIG. 21 showing the reel being disassembled from the surfboard insert.

The reel assembly 204 includes a reel 248 which has a pair of locking tabs or snaps 251 and 253 which may be disposed on opposite sides thereof to be grasped manually by the user and pressed inwardly manually to release the reel 248 from the insert 214 as indicated in FIG. 24. Each locking tab such as the locking tab 251 includes a barb such as a barb 255 which engages undercuts such as an under cut 257 of a locking notch such as the locking notch 258. A pair of finger actuators 259 and 262 are each movable inwardly resiliently and are attached to and control the locking tabs 251 and 253, respectively.

The reel 248 includes a radial neck portion or port 264 terminating in an annular flange 265 similar to the neck portion and annular flange of the reel of the system 10. On the upper portion of the reel 240 there is disposed a digital temperature gauge display 266 to provide the user with the ambient temperature during use of the system 200. Additionally, disposed adjacent to the display 266, is a tide chart display 268 to enable the user to be provided with tide information.

Figure 25:
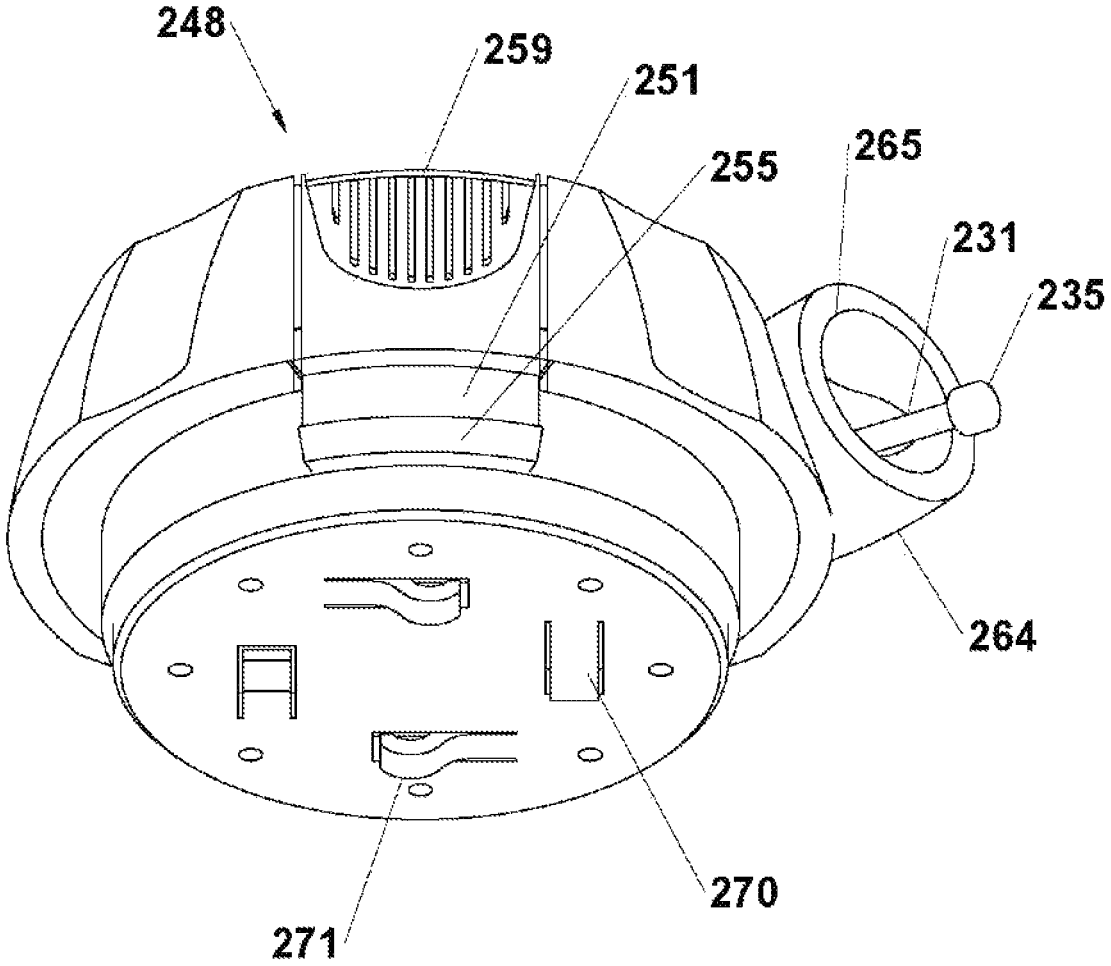
FIG. 25 is a pictorial view of the reel illustrating the underside thereof.
Figure 26:
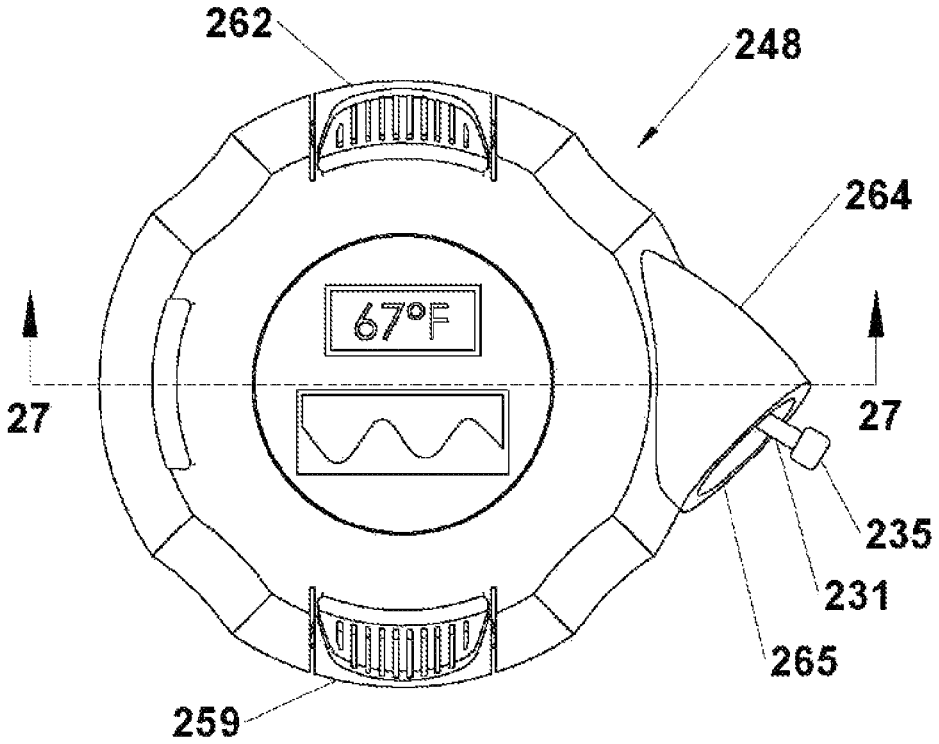
FIG. 26 is a top plan view of the reel of FIG. 24.

As best seen in FIG. 25, in order to securely attach releasably the reel 248 to the insert 214, molded spring tabs such as the spring tabs 270 and 271 on the underside of the reel 248 engage a bottom wall 273 of the insert 214.

Figure 27:
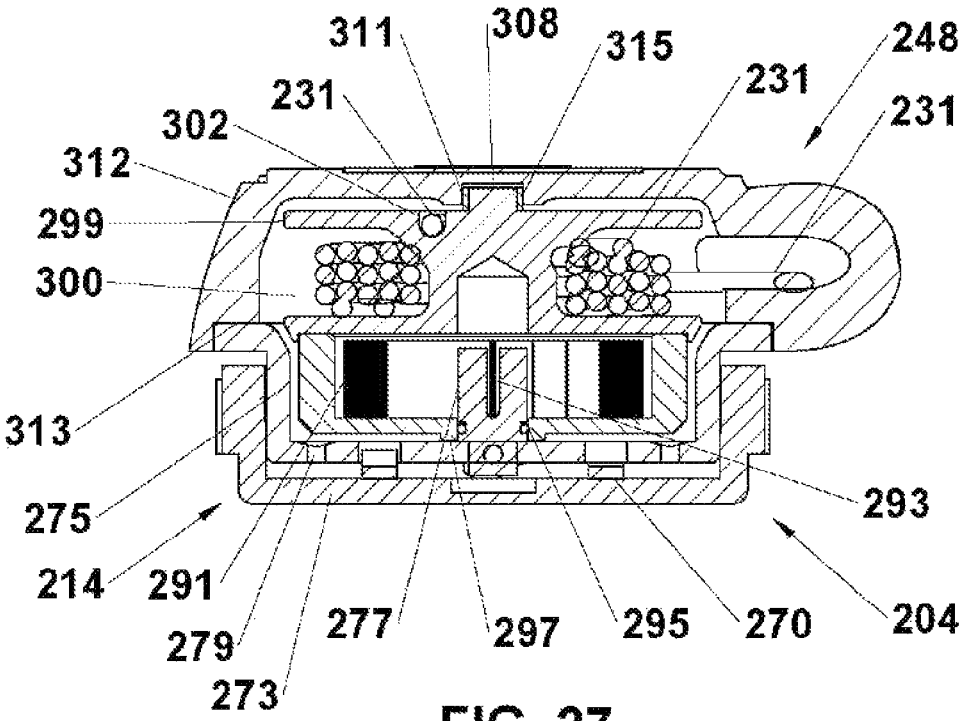
FIG. 27 is a sectional view of the reel of FIG. 26 taken substantially on line 27-27 thereof.
Figure 28:
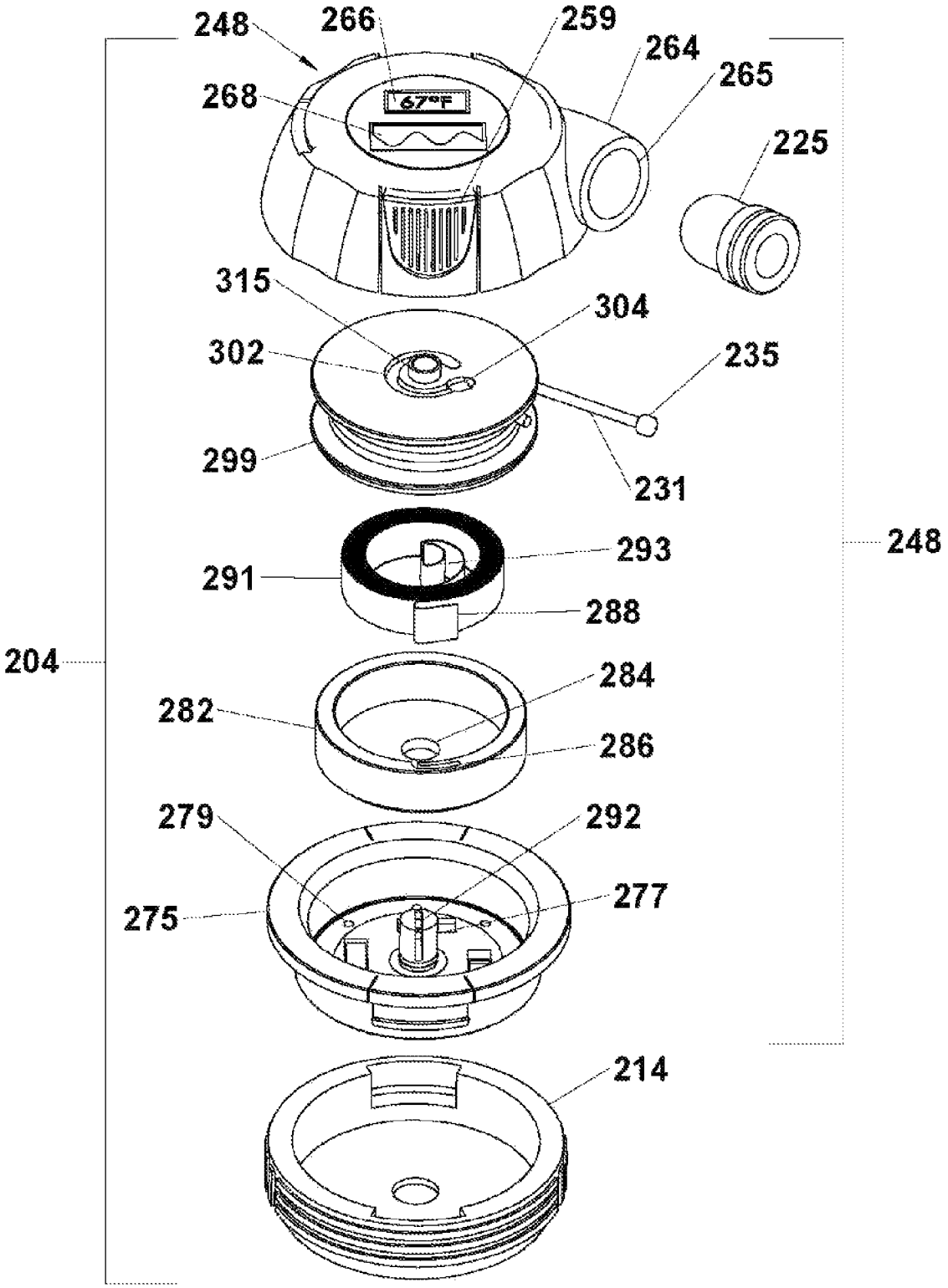
FIG. 28 is a reduced scale exploded view of the retractable surfboard leash reel assembly of FIG. 24.

The reel 248 includes a cup shaped stationary bottom housing 275 having an internal centrally disposed upstanding arbor 277, and having a series of drain holes such as a drain hole 279, the arbor 277 receiving rotatably the spring housing 282 having an opening 284 through which the arbor 277 extends. Is shown in FIG. 28, a spring locking slot 286 in the spring housing 282 received this fixedly a spring that powder and 288 of a spiral or coiled spring 291. A slot 292 in the upper end of the arbor 277 fixes the inner end 293 of the spiral roll spraying 288. As best seen in FIG. 27, a bottom dynamic seal 295 seals the spring housing 282 to the arbor 277 to prevent or at least greatly inhibit water from entering the interior of the reel 248. In this manner, as compared to the reel of the system 10, only a single seal is required.

Figure 29:
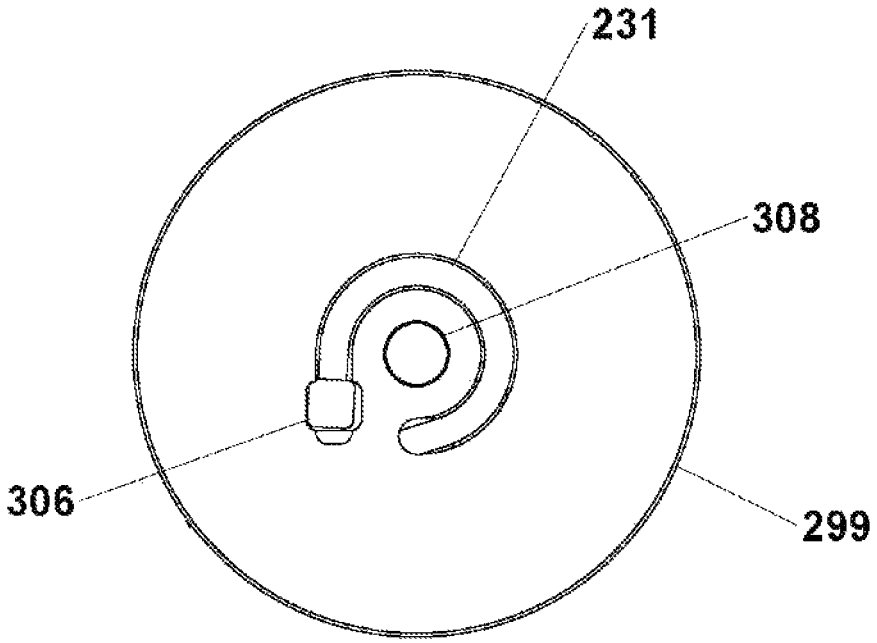
FIG. 29 is a top plan view of the spool of the reel of FIG. 24.
Figure 30:
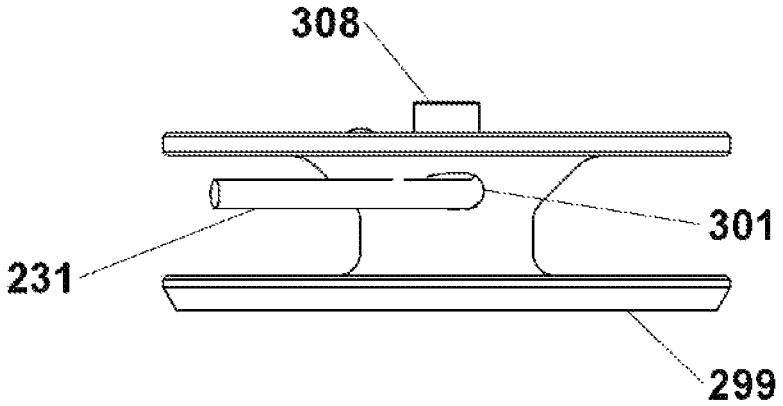
FIG. 30 is a side elevational view of the spool of FIG. 29.

A spool 299 is fixed to the upper portion of the spring housing 277 and includes an annular cord or line receiving recess 300 (FIG. 27) to enable the retractable line 231 to be wrapped thereabout, with its inner end portion extending through an exit opening 301 at the inner portion of the spool 290 and into a curved groove 302 on the upper surface of the spool 299 as best seen in FIG. 29. In this manner, the inner end of the line 231 is anchored by means of an inner enlarged line end 306 to the spool 299.

A centrally disposed upstanding post 308 is disposed rotatably within an opening 311 in the underside of an inverted cup-shaped cover 312, and fits within a sleeve bearing 315. The cover 212 is bonded or otherwise suitably fixed to the upper rim of the bottom housing 275. In this manner, the spool and the spring housing rotate within the bottom housing 275 when the line in 231 is pulled out of the reel 248.

Figure 32:
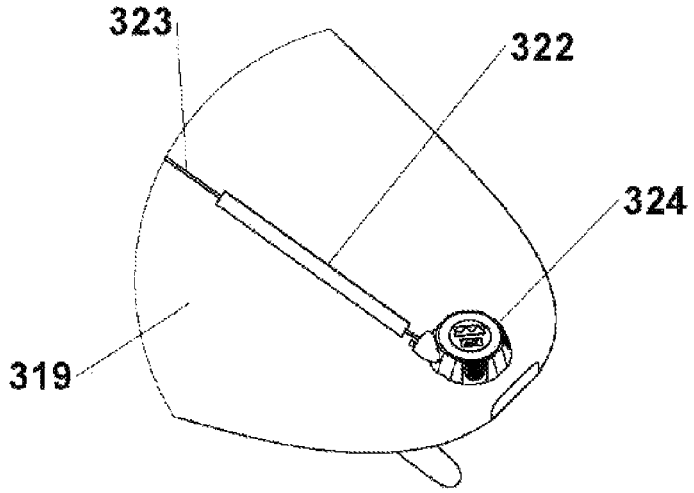
FIG. 32 is an enlarged pictorial view of the circled portion of FIG. 31.
Figure 31:
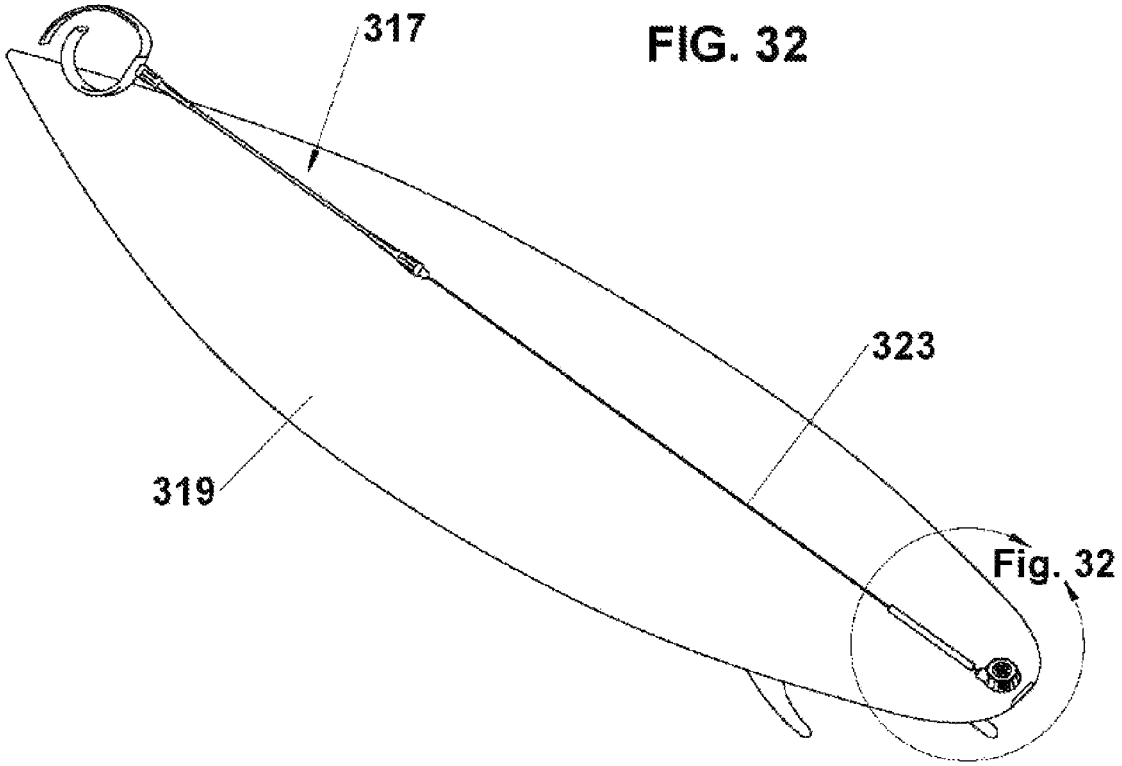
FIG. 31 is a pictorial view of a further retractable surfboard leash system having a rail saver, illustrating the leash system being fully extended.

Referring now to FIGS. 31 and 32, there is shown another retractable detachable surfboard leash system 317, which is also constructed in accordance with still a further embodiment of the invention. The system 317 is adapted to be detachably secured to a surfboard 319, and includes a rail saver 322 which serves a similar purpose as the rail saver 207 of FIG. 20. The rail saver 222 is tubular in shape and is fixed to the end of a retractable leash line or cord 323 extending from a reel 324. As indicated in the drawings, when the leash line 323 is fully extended from the reel 324, there is sufficient tension on the line to cause potential damage to the surfboard 319, but the rail saver 322 is composed of sufficiently soft or pliable material to prevent or minimize damage to the surfboard 319. The tubular rail saver 322 is sufficiently small in diameter to enter the reel 324 and be able to be wound up when the line 323 retracts.

Figure 35:
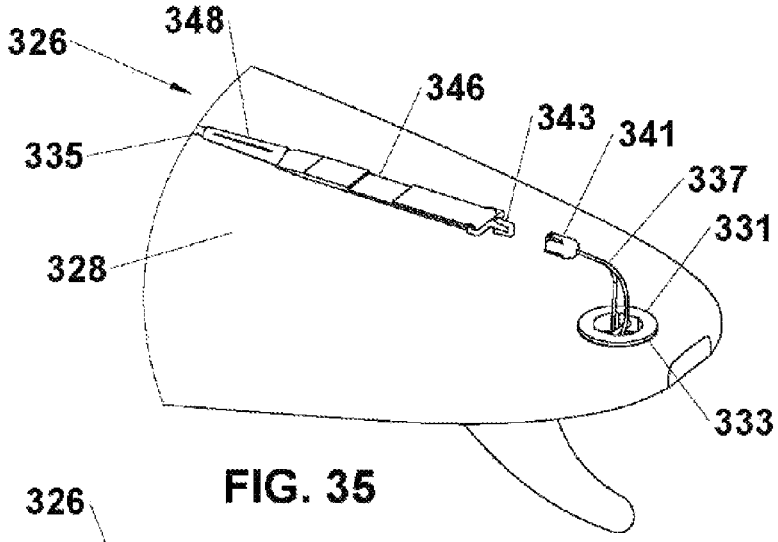
FIG. 35 is an enlarged pictorial view of the circled portion of FIG. 34.
Figure 34:
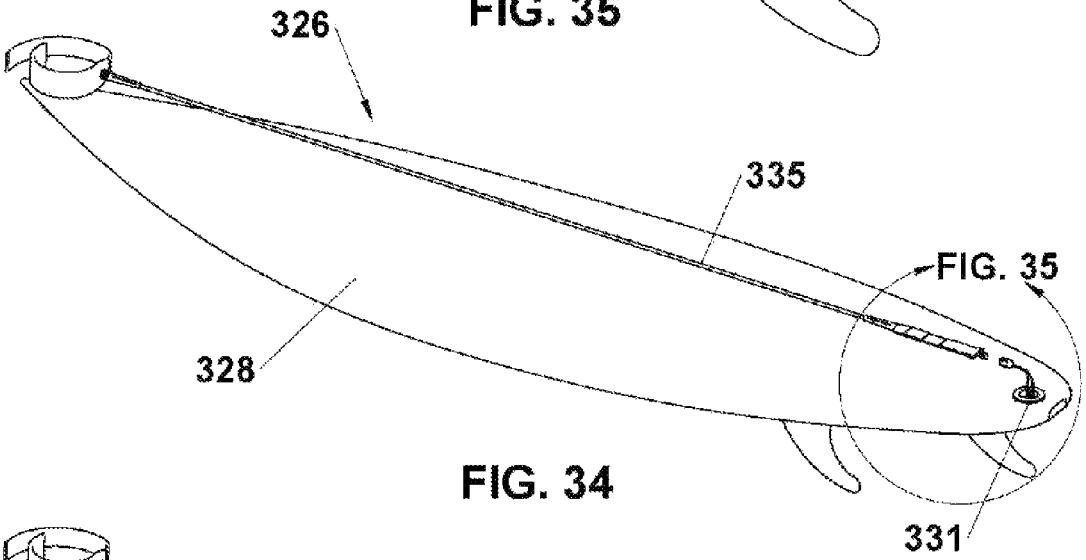
FIG. 34 is similar to FIG. 33, illustrating the surfboard leash system being detached from the surfboard and the leash being detached from the leash plug.
Figure 33:
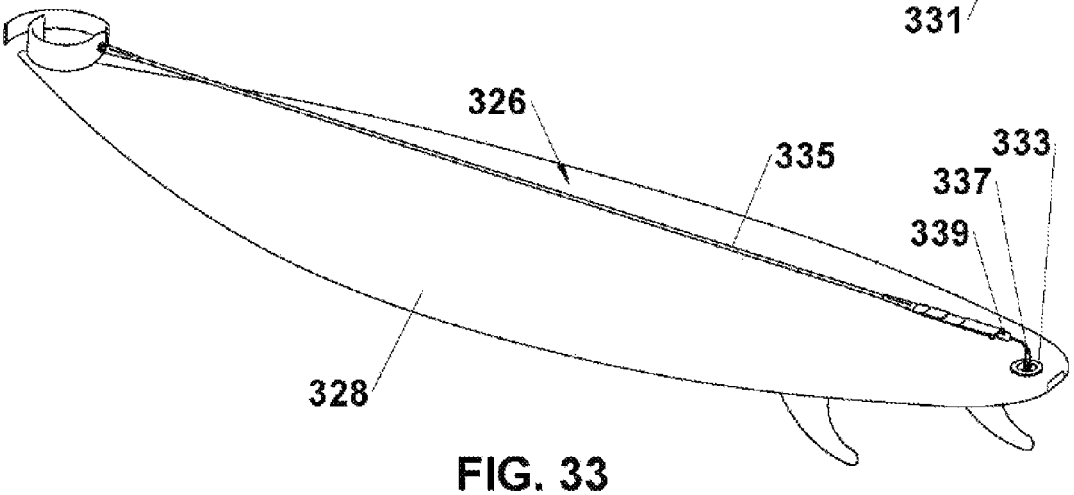
FIG. 33 is a pictorial view of a further non-retractable detachable surfboard leash system constructed according to a further embodiment of the invention.

Referring now to FIGS. 33, 34 and 35, they are shown a fixed surfboard leash system 326 which is constructed in accordance with yet another embodiment of the invention, and which is adapted to be releasably and detachably connected to a surfboard 328. The system 326 includes a removable plug 331 for the surfboard 328 and is adapted to engage releasably in insert 333. A leash line or cord 335 is attached at one of its ends to the removable plug 331 by means of a snap connector or 339, which includes a female part 341 and a male part 343 to disengage as shown in FIG. 34. The male part 343 is connected to a rail saver 346, which in turn is connected to a connector 348 which is similar to the connector 61 of FIGS. 8 and 9, and to the connector 239 of FIGS. 22 and 23.

Figure 38:
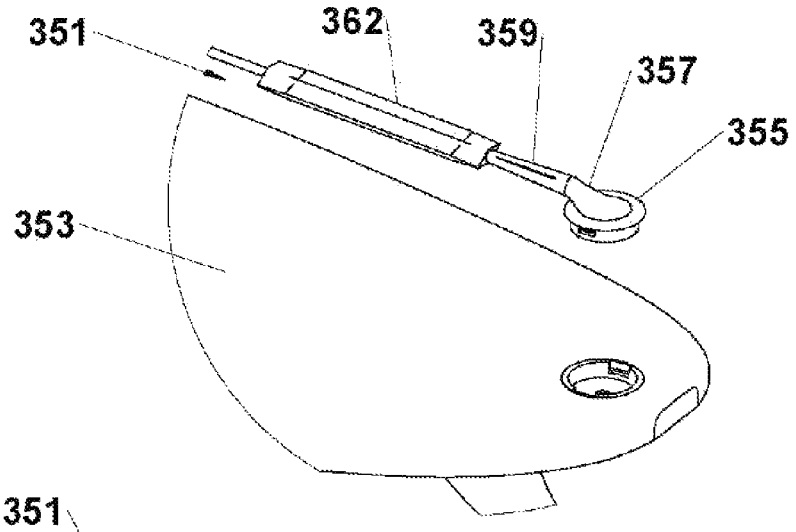
FIG. 38 is an enlarged view of the circled portion of FIG. 37.
Figure 37:
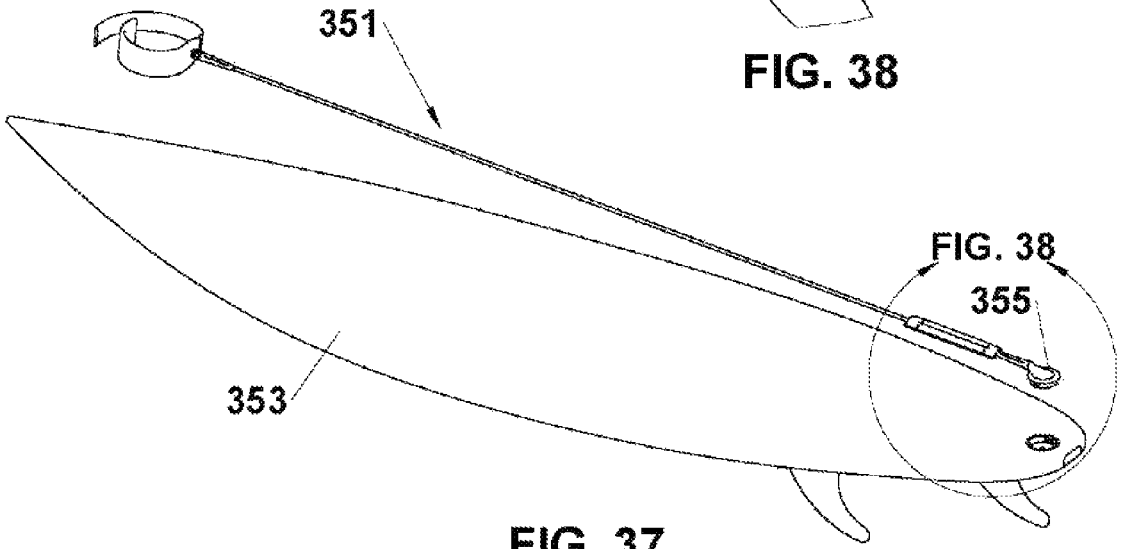
FIG. 37 is similar to FIG. 36, illustrating the surfboard leash system being detached from the surfboard.
Figure 36:
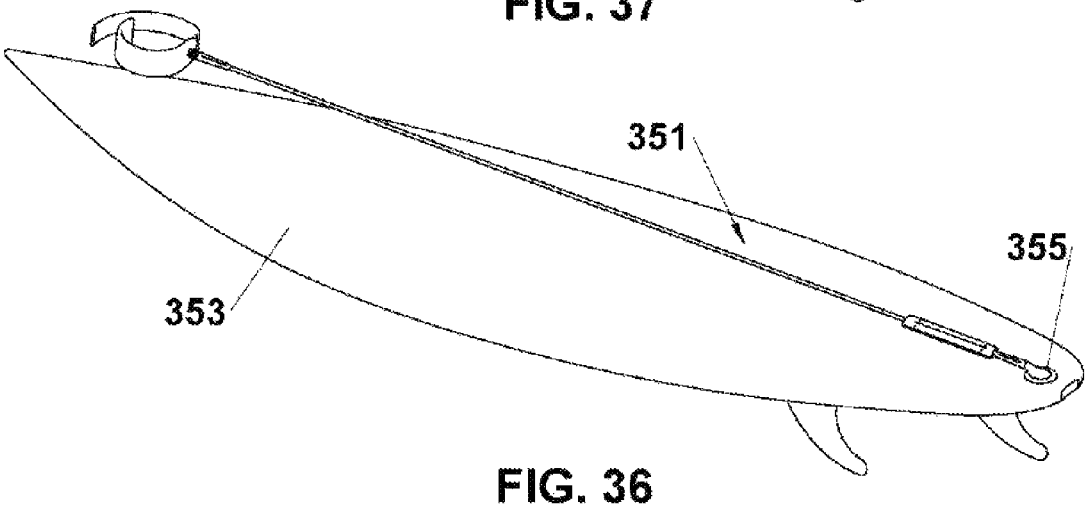
FIG. 36 is a pictorial view of a still further non-retractable detachable surfboard leash system constructed according to still a further embodiment of the invention.

Referring now to FIGS. 36, 37 and 38, there is shown a fixed surfboard leash system 351, which is also constructed according to a further embodiment of the invention, and which is adapted to be detachably secured to a surfboard 353.

The system 351 includes a removable plug 355 having secured thereto a low profile design connector, which includes a portion 357 and a portion 359 attached fixedly to a rail saver 362. The connector 357, 359 is similar to the connector 348.

It should be understood that when words such as "about," "approximately," "substantially" or the like are used herein, a tolerance of plus or minus 20 percent may be employed.

While particular embodiments of the present invention have been disclosed, it is to be understood that various different modifications are passing and one contemplated within the true spirit and scope of the appended claims. There is no intention, therefore, of limitations to the exact abstract or disclosure herein presented.

What is claimed is:

1. A surfboard leash system for a surfboard, comprising:

an insert adapted to be disposed within the surfboard;

a reel assembly releasably connected to the insert and having an arm portion terminating in an annular flange;

a first elongated line having a first end attached to the reel assembly and a second end capable of being extended from and retracted to the annular flange of the reel assembly;

a second elongated line releasably connectable at a first end to the second end of the first elongated line and adapted to being releasably attached at a second end to a user of the surfboard;

the reel having a cup shaped housing having an internal arbor;

a spool having the first line wrapped thereabout and being rotatably mounted on the arbor;

a spring housing;

a spiral spring fixed at one of its ends to the spring housing and fixed at its other end to the arbor; and a bottom dynamic seal seals the arbor to the spring housing.

2. The system of claim 1, wherein the insert includes locking notches, and wherein the reel includes spring tabs for providing an upward force to the bottom of the reel assembly to help maintain the mating between the tabs of the reel assembly and the notches in the insert.

3. A system according to claim 1, further including at least one shock absorber.

4. A system according to claim 3, further including a swivel connected to the shock absorber.

5. A system according to claim 1, wherein the reel includes a cover having a pair of manually operable finger actuators for controlling a pair of locking tabs engaging locking notches in the bottom housing.

6. A system according to claim 1, further including at least one electronic display.

7. A system according to claim 6, wherein the display is a digital temperature gauge display.

8. A system according to claim 6, wherein the display is a tide chart display.

9. A system according to claim 1, further including a rail saver.

10. A system according to claim 9, wherein the rail saver is a sleeve connected to the end portion of the retractable line.

* * * * *